US006320113B1

(12) United States Patent
Griffin et al.

(10) Patent No.: US 6,320,113 B1
(45) Date of Patent: Nov. 20, 2001

(54) SYSTEM FOR ENHANCING THE SOUND OF AN ACOUSTIC INSTRUMENT

(75) Inventors: Steven F. Griffin, Albuquerque, NM (US); Chance C McColl, Kirkland, WA (US); Sathya V. Hanagud, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 1062 days.

(21) Appl. No.: 08/683,705

(22) Filed: Jul. 18, 1996

Related U.S. Application Data

(60) Provisional application No. 60/001,229, filed on Jul. 19, 1995.

(51) Int. Cl.[7] ..... G10H 1/00
(52) U.S. Cl. ..... 84/738; 84/DIG. 10
(58) Field of Search ..... 84/735, 736, 738, 84/DIG. 10

(56) References Cited

U.S. PATENT DOCUMENTS

| | | | | |
|---|---|---|---|---|
| 2,568,797 | * | 9/1951 | Eland | 84/DIG. 10 |
| 4,151,368 | * | 4/1979 | Fricke et al. | 84/DIG. 10 |
| 4,236,433 | * | 12/1980 | Holland | 84/DIG. 10 |
| 4,245,540 | * | 1/1981 | Groupp | 84/735 X |
| 4,484,508 | * | 11/1984 | Nourney | 84/DIG. 10 |
| 4,697,491 | * | 10/1987 | Maloney | 84/DIG. 10 |
| 4,911,057 | * | 3/1990 | Fishman | 84/DIG. 10 |
| 5,056,400 | * | 10/1991 | Wachi et al. | 84/DIG. 10 |

* cited by examiner

*Primary Examiner*—Stanley J. Witkowski
(74) *Attorney, Agent, or Firm*—Thomas, Kayden, Horstemeyer & Risley

(57) ABSTRACT

A system is disclosed that provides sound control for an acoustic musical instrument. Typical to all acoustic instruments, the instruments have a structure or housing that defines a vented acoustic chamber. An input or sound inducing mechanism (such as strings of a guitar) imparts a vibration to the structure which causes acoustic waves to resonate within the acoustic chamber. The motion of air in and out of the vent causes acoustic waves to emanate from the chamber that combine with the acoustic waves emanating from the structure to form sound/musical notes. In accordance with the invention, a system controls the sound emanating from such an acoustic instrument. In accordance with one embodiment of the invention, at least one integral or smart sensor is disposed adjacent a sensing location of the structure, and the sensor is configured to generate sensed electric signals indicative of the magnitude of structural vibration of the structure at the sensing location. A controller in communication with the sensor, includes a processor for processing the sensed electric signals in accordance with a predetermined method (e.g., computer program). In response, the controller produces output electrical signals. At least one integral or smart actuator is disposed adjacent an actuator location of the structure, and the actuator is in communication with the controller and is configured to receive the output electrical signals and induce structural vibration of the structure at the actuator location. As a result of the foregoing structure and operation the induced vibration of the structure at the actuator location creates acoustics that alter the sound emanating from the acoustic chamber as well as that emanating from the structure. Specifically, signature frequency response characteristics of acoustic instruments like damping and frequency values of structural and acoustic resonances can be altered to alter the sound of the acoustic instruments. The use of integral or smart sensors and actuators put no restrictions on the movement of the acoustic instrument player since they are part of the guitar structure.

3 Claims, 29 Drawing Sheets

First Mode

Second Mode

First Mode

Second Mode

SYSTEM FOR ENHANCING THE SOUND OF AN ACOUSTIC INSTRUMENT

This application claims the benefit of U.S. Provisional Patent Application Ser. No. 60/001,229; Filed Jul. 19, 1995.

BACKGROUND OF THE INVENTION

In 1990, the "Mendelssohn" Stradivarius violin sold at Christie's in London for $ 1,686,700. A good violin at a typical music store sells for around $ 2,000. What is it about the Stradivarius that makes it cost almost 1,000 times as much? The structure and geometry of the two instruments are very similar, yet subtle differences in the structural dynamics of the two instruments cause them to vibrate differently in response to an excitation by a violinist's bow. This, in turn, causes differences in the sound produced by the two instruments which ultimately determines quality and, to a large extent, price. If it were possible to force the less expensive violin to vibrate like the Stradivarius, the legendary sound would follow.

The relatively new field of smart structural/acoustic control is centered around changing the structural dynamics of an acoustically radiative structure to change, usually to suppress, the sound resulting from vibration of the structure. This is done by connecting actuators that are integrated into the structure in a control loop with sensors that are either in the acoustic field or also integrated in the structure. Smart structural/acoustic control also has the potential to force one acoustically radiative structure to behave like a target acoustically radiative structure, thus replicating its acoustic properties. The less expensive violin might be forced to sound like a Stradivarius. The concept of acoustic replication using smart structures has far reaching implications, from the field of acoustic musical instruments to aircraft cockpits.

To provide a background, a brief review of active acoustics leading to smart structural acoustics is presented. Smart structural acoustics is a relatively recent subset of the broader field of acoustic control wherein an acoustically noisy structure may be controlled at the structure through integrated sensors and actuators. This integration is such that the sensors and actuators are load-carrying parts of the structure as well as control elements. The field of smart structural acoustics has emerged in a natural progression: first, acoustic control by acoustic sources; then, by vibration inputs; and finally, by integrated sensors and actuators or, smart structural acoustic control.

Additionally, a review is given of literature on the acoustic guitar. This instrument has inspired a significant amount of analytical and experimental research from the perspective of acoustics and structural dynamics. As such, there are identified dynamic parameters in the literature that could potentially be further "tuned" using active acoustic control to accomplish desired changes in acoustic parameters.

In most applications, acoustic control is implemented in order to suppress unwanted noise through attenuation or other mechanisms. Sound attenuation is usually implemented through sound-absorbing materials for sounds of medium and high frequencies. Because the thickness of the sound absorption material necessary to produce constant attenuation increases with decreasing frequencies, there is a practical limit on its use at relatively low frequencies. In this low frequency region, active acoustic control has found applications.

The principles underlying active acoustic control have been understood at least since 1802 when Young's principle of interference was introduced. The principle suggests cancellation of a sound wave propagating in space by the addition of an inverse wave. This principle forms the basis of active noise control. Huygen's principle, as applied to acoustics, is an extension of Young's principle for multiple dimensions. Huygen's principle states that the sound field inside a surface that is produced by a source outside the surface can be exactly reproduced by an infinite array of secondary sources distributed along the surface. Since an infinite array of secondary sources are not realizable, in practice, a finite number of secondary sources can be "field-fitted" to achieve an optimum result.

Despite the longevity of the underlying principles of active noise control, one of the first practical implementations was described by Lueg in a German patent in 1933 and in a U.S. patent in 1934 (U.S. Pat. No. 2,043,416). Phase reversal in Lueg's one-dimensional duct was accomplished by considering the electronic system as a transmission line whose length determined the time delay. Lueg also proposed cancellation in a space very near a loudspeaker and in an open space using a microphone and a loudspeaker. It has been found more recently that cancellation at a point is done at the expense of increased noise at other locations in the field. Also, Lueg's approach to control of noise in an open space was probably not viable since successful experiment implementations of this are much more recent and inevitably involve more than one microphone and speaker.

Little was published in the field of active control following Lueg's patent until the 1950's. In 1953, Olson published research on an electronic sound absorber and Conover made early attempts to control transformer noise using a single loudspeaker. Frequency performance range of Olson's devices were limited at low frequencies by loudspeaker performance and at high frequencies by phase errors and electronics. An attenuation is achieved of almost 25 dB in the range of 60 to 80 Hz accompanied by an almost linearly decreasing attenuation up to around 500 Hz where there is an increase of sound pressure of 5 dB. This early work started to map out the frequency range of usefulness of active versus passive noise control, where active is most effective in the range of near DC to 500 Hz and passive is most effective above 500 Hz. This upper limit on active control should continue to increase as theory develops, computing power continues to increase, and computing equipment cost continues to decrease.

Applications in which modern active noise control research continue are plentiful, including approximately one-dimensional problems such as ducts and noise-reducing headsets and multidimensional applications such as cylinder interiors and transformers. Cylinder interiors are of particular interest because of their natural extension to fuselages and launch vehicles.

The idea of noise reducing headsets started as a more advanced version of Lueg's system for controlling duct noise and was implemented by Olson. For low frequencies, sound waves in ducts propagate as approximately one-dimensional plane waves. As the sound frequency increases, the sound propagation becomes multidimensional and much harder to control as the plane wave assumption breaks down and transverse resonances cause pressure fluctuations through a cross section. Active noise control has been applied to fan-induced duct noise in commercial air handlers at low frequencies. The limiting frequency for noise reduction of up to 20 dB for most duct structures is around 500 Hz. This limitation is also imposed by sampling and processing speeds.

Internal cylinder noise can be a pseudo two-dimensional problem or a three-dimensional problem depending on whether the noise sources and secondary sources lie in the same cross-sectional plane and the frequency of the noise. In 1976, Kempton, put forth one of the first illustrations of a multidimensional active acoustic control problem using an array of "anti-sources" to cancel the far-field of a monopole source. Lester and Fuller used four interior monopole control sources to attenuate noise by around 20 dB within a cylindrical cross section caused by 2 exterior monopole noise sources. Later, Fuller, and Jones and Jones and Fuller performed similar studies using a structural control actuator. These will be covered in greater detail in the next section. Elliot et al. determined that as long as secondary sources couple sufficiently with modes that are excited by the primary source, it is possible to achieve noise reduction without locating secondary sources near the primary source. Noise control has also been applied to the characteristic low frequency hum of transformers. Angevine showed attenuation levels of 16 dB using 26 secondary sources surrounding the transformer.

When the source of noise to be controlled is a structure, the use of acoustic sources for control is available in addition to the option of applying a vibrational source directly to the structure. The addition of a sensor and a control methodology can potentially modify the structure so that noise does not propagate as readily at the frequencies of interest. An advantage for direct structural actuators is illustrated by an inherent disadvantage in acoustic source control. When there are many phase changes across the surface of a noise source, as in a panel structure vibrating in a higher mode, many acoustic sources are needed for control. In the case of the panel, there should be at least one acoustic source for each antinode on the structure. Additionally, it has been found in the control of interior noise of cylinders that direct structural actuation avoids control spillover effects encountered using acoustic sources. Control spillover is the effect of generating additional, unwanted noise when control is implemented due to an inexact match of the control field to the primary field with respect to spatial distribution.

Some of the earliest works in the literature involving direct structural actuation to provide vibration inputs were published in the Soviet Union. In 1966, Knyazev and Tartakovskii used vibration pickups and vibration inputs to control plate vibrations by introducing active damping. They also noticed an average reduction of 16 dB in acoustic pressure over the area of the plate when vibrating at 390 Hz. This frequency was located very close to a resonance of the plate. A follow-up paper in 1967, by Knyazev and Tartakovskii, was directed primarily at acoustic attenuation of noise radiated by the flexural waves of a plate. Experimental results indicated an average of 7 dB reduction in acoustic pressure across a frequency range of DC to 1900 Hz. They noted that the tuning of vibration dampers to minimize the noise field does not coincide with the tuning of vibration dampers to minimize vibration and that the maximum radiation attenuation of noise occurs near the location of the damper. In another relatively early publication from the Soviet Union in 1987, Vyalyshev, Dubinin, and Tartakovskii presented a theoretical examination of reductions in sound transmission through a plate with an auxiliary point force used as a control actuator. They observed that reductions in sound transmission through the plate could alternately be viewed as an increase in the impedance of the plate.

Early pioneering work in the United States using direct structural actuators to provide vibration inputs began with Jones and Fuller on active control of a sound field within a cylinder (this followed an earlier reference work by Lester and Fuller using acoustic sources on the same problem). This cylinder study was directed towards the control of cabin noise in the advanced turboprop aircraft. A control relation is derived, in this experimental study, by producing the same sound field at a given microphone location using both an acoustic source that is supposed to simulate noise and a secondary vibration control source. Both sources were then switched on and their phase varied with respect to each other while sound pressure level (SPL) was measured at several interior locations as a function of this variation. Both resonant and off-resonant noise frequencies were investigated. Attenuation of sound pressure of up to 20 dB was obtained. An additional study by Jones and Fuller showed reductions of up to 30 dB at acoustic resonance in the cavity using two vibration control sources and two microphone error sensors. In this case, the control was formulated by minimizing a quadratic cost function based on error signals from the microphones.

An enhancement to providing direct structural actuation with a point force is to provide direct structural actuation using actuators that have been developed for smart structures. The use of smart structures started in the field of vibration control. In acoustic control, the objective changes from one of minimizing or altering structural response to one of minimizing or altering acoustic response. These two objectives often require very different control laws, but both may be achievable using the same actuator. A smart structure actuator can either be imbedded in or bonded to the host structure. It provides a source of direct structural actuation without the added space and structural grounding requirements necessary with a shaker providing a point force. In addition, point force actuation is more prone to spillover and shakers exhibit a certain back reactance that may require consideration in the model of the structure. Smart structure actuators only slightly increase the mass and stiffness at the point of application. The primary smart structure actuator used, in vibration applications, is the surface-bonded piezoceramic. Transverse deflections on application of a voltage in the poling direction of the through-the-thickness poled piezoceramic translate into in-plane surface tractions applied to the structure.

The first investigation of what could be called a smart structure actuator was directed at vibration control by Forward. He used bonded piezoceramics as sensors and actuators to control the vibration of a mirror subjected to acoustic excitation. Other early work, which concentrated on vibration control of beam structures, includes that of Bailey and Hubbard, who investigated the use of poly vinyldene fluoride (PVDF), a piezoelectric polymer, as a distributed parameter actuator on a cantilever beam. Obal and Hanagud, Obal, and Calise formulated an optimal control law for vibration suppression of a beam using surface-bonded piezoceramic sensors and actuators. They also found that for the assumptions of uniform beam stiffness and perfectly rigid bonds, piezoceramics could be modeled as concentrated line moments applied to the beam at the boundaries of the actuators. Baz and Poh investigated optimal location and control gains for minimizing beam vibration amplitude using piezoceramic actuators. The interaction between piezoceramic actuators and beam structures was first thoroughly analyzed by Crawley and De Luis and later by Crawley and Anderson. An important conclusion was that the bonding layer should be very thin and that the piezoceramic actuator should be stiff compared to the host structure for maximum force at a given voltage. They also came to a similar conclusion as references to Obal and Hanagud, et al. that, under these conditions, the action on the beam by the piezoceramic can be approximated by line moments proportional to the applied voltage at the boundaries of the piezoceramic. Early work on the incorporation of one-dimensional active piezoceramic elements into more complicated truss structures for vibration suppression was done by Fanson and Chen. More recently, Bronowicki and Betros developed a hybrid method for modeling piezoceramic sensing and actuation of complicated truss-beam combination structures which uses a finite element code to generate structural mode shapes and a thermal analogy to model both sensing and actuation.

Investigations into the more general problem of actuation of plates using surface-bonded piezoceramic actuators are more relevant to acoustic problems, but also have their background in vibration suppression problems. Approaches to smart structure plate actuation can be divided into two categories: (1) continuous exact or approximate solutions and (2) discrete formulations involving a finite element model (FEM).

Among continuous solutions, Dimitriadis, Fuller, and Rogers put forward a theoretical paper postulating the interaction between a piezoceramic plate bonded to a plate substructure. A perfect bond and a uniform bending applied by the actuator at all points within the actuator boundaries were assumed, resulting in a spherical deformation of the plate due to the actuator. It was predicted, analogous to the beam case, that the piezoceramic could be replaced by line moments along the borders of the piezoceramic actuator. Also, it was shown that for symmetric distribution of an actuator about a nodal line of a given vibrational mode, excitation of that mode was theoretically impossible. Optimum actuator position for excitation of a vibrational mode was said to be near nodal lines. A more general statement of this principle by Fuller, Rogers, and Robertshaw is that the center of the actuator should be in a region of high structural surface strain of a mode for excitation of that mode. Crawley and Lazarus developed a model of induced strain actuation that was applicable to isotropic and anisotropic plates. The model was experimentally verified for the case of piezoceramic material covering the majority of both surfaces of cantilevered plate test articles in static deflection due to voltage applied to the actuators. Kim and Jones included the effect of a finite thickness bonding layer in actuation of a plate by surface-bonded piezoceramic actuators. They also presented some results on optimal thicknesses of the actuator for a constant applied field. In a study of segmentation of piezoceramic sensors and actuators bonded onto plates, Tzou and Fu found that proper segmentation of piezoceramics result in the ability to sense and actuate modes for which piezoceramics are evenly distributed about a nodal line of the mode.

The inherent limitation in all of the continuous models is that the plate substructure problem must be amenable to a continuous exact or approximate solution in order to solve the combined piezoceramic/plate problem. For evaluation of potentially more complex problems, approaches have been developed which fall into the category of discrete solutions involving FEM. The first piezoelectric finite element for structural dynamics that could be found was derived by Allik and Hughes. Also, McDearmon published a method to add piezoelectric properties to structural finite elements through a matrix manipulation of elastic and heat transfer element matrices. In a much more recent study, Ha, Keilers, and Chang developed a composite finite element with piezoceramics included as outer layers of the element. The specific element was eight-noded, with three displacement degrees of freedom and one voltage degree of freedom per node. A modal expansion was used to show the feasibility of introducing active damping although no explicit control algorithm was formulated. Comparisons were also made between predictions of static and dynamic deflections using an assembled model that included the composite element and experimental data on cantilevered plates.

Piezoceramics are also used as actuators in the majority of smart structure acoustic control research found. Piezoceramics offer the necessary frequency response and force authority for active acoustic control. In addition, the distributed nature of the piezoceramic wafer can be used to spatially filter selected modes that are acoustic radiators by proper placement of the actuator material. Rogers, Fuller, and Liang have also proposed using embedded nitinol fibers, a shape memory alloy, to control sound transmission through a panel. Activation of the nitinol fibers results in a static change in mechanical properties and mode shapes of the panel that can reduce sound transmission.

There have been a number of theoretical papers considering smart structural acoustic control applied to both beam and plate structures. Clark and Gibbs investigated the use of a simply supported plate with one piezoceramic actuator to demonstrate a higher harmonic control approach. Control of sound radiation due to subsonic vibrational waves impinging on structural discontinuities was researched by Guigou and Fuller. In this study, active control forces due to bonded piezoceramics and shakers, were both shown to be effective at minimizing the radiated acoustic field. Clark and Fuller present a theoretical paper examining model reference-based control on the acoustic field resulting from a simply supported beam with piezoceramic actuators and structural sensors. The structural response is driven by a controller to some predetermined reference response which results in favorable acoustic response. It was shown analytically that the same degree of control that can be achieved by any number of error sensors in the acoustic field and n actuators can also be achieved by using n structural sensors and n actuators. This provides a means to get a high degree of acoustic control through a detailed initial survey using many microphones in the acoustic field, and to maintain that control with a reduced number of structural sensors.

There have also been studies that include experimental validation implementing smart structural acoustic control of plates. In a purely experimental study, Fuller, Hansen, and Snyder achieve a global attenuation on the order of 45 dB using a piezoceramic actuator and a form of open-loop control which varies the phase between the disturbance and the control signals. This was done at two distinct resonant frequencies of a simply supported plate. In another experiment, Clark and Fuller compare the number of piezoceramic actuators used to control on-resonant and off-resonant excitation of a simply-supported plate. They found that for on-resonant excitation, more piezoceramic actuators failed to elicit better performance, while for off-resonant cases more piezoceramic actuators increased performance. Also, Clark and Fuller give an optimal placement methodology for piezoceramic actuators and PVDF structural sensors on a baffled, simply-supported plate. A Rayleigh integral approach is used to predict pressure fluctuation as a result of plate movement. Analytical results formulated using a linear quadratic optimal control theory are compared to experimental results. It was found that a single optimally-placed piezoceramic actuator and PVDF sensor can rival performance achieved with three arbitrarily-placed actuators and three microphone sensors. Van Niekerk, Tongue, and Packard used a pair of surface-bonded piezoceramic actuators mounted on a circular plate that was mounted in a duct to suppress a transient pressure pulse due to a loudspeaker that was also mounted in the duct. They found reductions of up to 15 dB in a microphone that was placed downstream of the plate when the controller was active.

Smart structural acoustic control applied to flexible plates that are backed by sealed rigid cavities has also been the subject of a small body of recent research. This model is important because it adds insight to problems of sound propagation into aircraft cabins, where the primary noise source is due to new, more efficient, but noisier turboprop engines and into spacecraft launch vehicles where excitation of the payload fairing can create a harsh enough internal acoustic field to interfere with sensitive payloads. Lyon was the first reference found to investigate passive suppression of sound propagation into a sealed, cavity-backed plate, but the first references investigating smart structural acoustic control on the related problem of sound propagation into a two-dimensional cavity with a flexible beam boundary were by Banks and Fang almost 30 years later, in 1991. In this later theoretical work, piezoceramic actuators were bonded to both sides of a clamped, flexible beam boundary, and a time domain state space formulation was derived for coupled structure/fluid system and used to investigate active control of noise in the cavity and beam amplitude due to a periodic beam excitation. Kohsigoe, Gillis, and Falangas investigated sound transmission through an elastic, simply-supported plate into a three-dimensional cavity with rigid sides, a lightly damped back wall, and a rigid inner box located at the center of the cavity. The theoretical development includes a formulation for the equation of motion of the plate and equations for resulting pressure inside and outside of the cavity. Active noise control is investigated for controlling noise transmission into the cavity using the piezoceramics as actuators. In an entirely experimental study, Ellis and Koshigoe constructed a cavity with rigid sides and back and clamped a flexible plate to the front with a piezoceramic actuator and accelerometer sensor in order to study control of harmonic noise transmission due to an external loudspeaker. In a theoretical study, Koshigoe and Ellis considered decreasing harmonic noise transmission through a simply-supported plate with surface-bonded piezoceramic actuators into a rigid cavity with a time-varying mean air density. Hill et al. conducted an experimental investigation of decreasing harmonic sound transmission due to a loudspeaker through a clamped plate with a pair of surface bonded piezoceramic actuators into a sealed, rectangular cavity with acoustically reflective sides and back. Low-order models, which captured the modes to be controlled, were fit to measured data for state space control design.

Two approaches are available for sensing in acoustic control of structures. The traditional approach is to sense the acoustically radiated field directly using microphones in the acoustic field. The second approach is to use any one of the smart structural sensors that have been developed for vibrational control. These include optical fibers, nitinol or constantin strain sensors, and PVDF or piezoceramics.

Piezoceramic sensors can be used as independent sensors or their functionality as sensor and actuator can be shared to form the sensoriactuator. In this embodiment, piezoceramic wafers serve as a collocated sensor and actuator. One advantage to smart structure sensors is the ability to spatially weight acoustically radiative modes by placing sensors in regions of high in-plane strain corresponding to the radiative mode.

Another advantage is the compactness of locating the sensor on the structure. A disadvantage is the necessity of formulating a relationship between a measurable structural parameter and the radiated acoustic pressure. This is only possible analytically for very few circumstances, as with the use of the Rayleigh integral to relate surface velocity to acoustic pressure when the structure is infinitely baffled. In the general case of a complex structure, this relationship between structural parameters and acoustic pressure is beyond the state of the art.

The determination of which modes are important as acoustic radiators and thus which modes to control, has been greatly simplified by the introduction of the wave-number transform, also called the k-transform. The k-transform is obtained by calculating the Fourier transform of a structure's spatial response. The resulting portion of the wavenumber spectrum below the wavenumber in the acoustic medium corresponds to the far-field radiation. The portion of the wavenumber spectrum above the wavenumber in the acoustic medium corresponds to the near-field radiation. This transform can be used to predict whether a vibrating structure will produce sound which propagates into the far field and to examine how changes introduced by active control will affect that propagation.

The majority of the active control approaches reviewed so far have been formulated in response to steady state sinusoidal disturbance inputs at one or multiple frequencies. The simplest control approach under these conditions is open-loop control. This can only be implemented when a very accurate representation of the disturbance signal can also be used to drive the actuators at a desired phase with respect to the radiating structure. The disadvantage of this approach is that it is not always possible to have a very accurate disturbance signal. A more sophisticated extension of this is the feedforward LMS adaptive approach. In this approach a quadratic cost function constructed of the acoustic error signals is minimized using superposed signals introduced by the actuator. An advantage of this approach is that it does not require a good estimate of the system and that it is relatively easy to implement in hardware. Smith, Fuller, and Burdisso found that for a broadband excitation, single-input-single-output (SISO) feedforward control did not give satisfactory performance in the attenuation of radiated sound from a plate. They found a multi-input-multi-output (MIMO) feedforward controller is necessary for significant acoustic attenuation. When the disturbance is broadband, a different approach is necessary for single-input-single-output systems. In order for the control to react quickly enough to the variable nature of the input, a feedback control approach must be formulated. Meirovitch and Thangjitham published one of the first theoretical studies using direct structural actuation and feedback control, but their approach was to minimize the vibration of a simply-supported elastic plate and to use the Rayleigh integral to check the effect of the control in the acoustic field. Also, they only attempted to control a harmonic disturbance. Bauman, Saunders, and Robertshaw used a Linear-Quadratic-Regulator (LQR) optimal method to suppress acoustic radiation from a beam that was excited by impulsive forces. They theorized that sound radiation from the beam would be suppressed by 73% with the controller configured to suppress vibration using LQR. Bauman, Ho, and Robertshaw also published a theoretical study investigating active acoustic control of broadband disturbances. Here, a feedback controller was designed for a clamped-clamped beam using a Linear-Quadratic-Gaussian (LQG) theory to minimize total radiated acoustic power.

The references all assumed direct structural actuation via an out-of-plane control force. There were also a few references found that investigated feedback control approaches using smart structural actuation. As was mentioned before, Banks and Fang described an acoustic cavity with one flexible beam boundary and smart structural actuation. Acoustic control was achieved using an LQR time domain approach, but the excitation was assumed to be periodic. Saunders, Cole, and Robertshaw examined stability criteria for collocated structural acoustic feedback control using sensoriactuators. They found that for partial state feedback of plant velocities and farfield radiation states, stability was not guaranteed, as is the case for direct velocity feedback in vibration control. Van Niekerk, Tongue, and Packard used an $H_2$ optimal control procedure to design a dynamic feedforward/feedback controller to suppress transmission of a transient pulse through the previously described circular plate in a duct with piezoceramic actuators. Feedforward signals were provided by two microphones in the duct and a feedback signal was taken as the velocity of the center of the plate as measured by a laser vibrometer.

Among the acoustic control of sound transmission through flexible plates into three-dimensional cavities using smart structure actuation, Koshigoe, Gillis, and Falangas proposed a feedback method which makes the applied voltage to the piezoceramic proportional to sound pressure inside the cavity, but with the phase adjusted so as to create damping in the acoustic modes. They theorized that the method should be effective for both plate and cavity controlled modes. In the experimental study by Hill et al, several feedback control approaches including LQG/Loop Transfer Recovery (LTR), H_, pole placement and LQG were implemented based on the reduced order state space model, but the only input disturbance considered was harmonic.

A reasonable body of technical research exists for two popular acoustic instruments: the violin and the guitar. Both have been studied with respect to their structural/acoustic properties to some degree. The violin is considerably more complex than the guitar. The primary reasons for this are the asymmetrical vibration characteristics of the assembled violin and the involvement of the entire violin body in the production of sound. Despite the symmetrical shape, the bass bar and the soundpost located approximately on either side of the bridge below the top plate cause the vibration of the violin to be very complex and asymmetric. In fact, the primary purpose of the soundpost is to introduce asymmetry. It also effectively couples the top and back of the violin. Hutchins provides an extensive review of the history of violin research. In contrast, the sound radiated from the assembled guitar is primarily due to the vibration of the top plate which has lower frequency mode shapes that are relatively simple in comparison. As a result, the guitar is particularly amenable to modeling in its lower frequency function.

Of technical research that has been devoted to the modeling of acoustic-structural behavior of the acoustic guitar, most reported papers are concerned with the lower band of natural frequencies. This domain starts with the air mode at around 100 Hz and extends to the lowest plate mode of the lower bout of the acoustic guitar, which usually occurs around 200 Hz. Successful models of this low frequency behavior have drawn on an analogy to a vented loudspeaker enclosure with a solid piston representing the lower bout and an air piston representing the air mass that moves in and out of the rose. The pistons are constrained by an equivalent spring and damper whose parameters are derived from experimental measurements.

Firth described an analogous acoustical circuit used to model vented loudspeakers to describe the first two modes of the guitar. Frequency and damping parameters for this model were taken from admittance measurements made on a representative acoustic guitar. The analogous acoustical circuit was then used to predict pressure emanating from the guitar in the frequency range of the air mode and the first plate mode. These predictions were compared to measurements of sound output and its phase with relation to an excitation force at the center of the bridge. Extending this approach, Caldersmith used the analogy of a vented loudspeaker but derived the two coupled differential equations that describe the air mass that moves through the rose of the guitar as an air piston and the lower bout of the guitar as an equivalent plate piston. Stiffness and damping parameters for the pistons were taken from resonance and logarithmic decrement measurements, but an approach was outlined to estimate an equivalent stiffness for the plate piston directly for an assumed clamped orthotropic plate. SPL was calculated as a sum of the contribution of the air piston and the equivalent plate piston. Christensen and Vistisen used a similar approach but derived frequency and damping parameters entirely from top plate mobility measurements. A three-piston model has also been proposed by Christensen as an extension of the two-piston model that also treats the guitar back as an equivalent piston. Similar three-piston models were also described by Rossing, Popp, and Polstein and Fletcher and Rossing. Christensen also proposed modeling all top plate resonances up to 600 to 800 Hz as harmonically oscillating simple sources. This study included experimental measurements of resonant frequencies, initial guesses at damping and area to mass ratios and subsequent tuning of parameters to match experimental SPL measurements at one point in the acoustic field. It neglects multipole radiation of antisymmetric modes that could be significant in locations other than the measurement point two meters directly above the top plate. No published work could be found that links the spatial distribution of movement at the lower bout directly to the resulting sound pressure. This necessarily precludes consideration of sound pressure generated by antisymmetric plate modes at multiple locations in the acoustic field.

There are several factors in the low frequency regime of the acoustic guitar that have been identified as important in determining the quality of music the guitar is able to produce and, ultimately, the quality of the guitar itself. Specifically, these factors all are identifiable from structural transfer function measurements and SPL measurements made on the guitar. A study on appraisal of quality in guitars and violins was done by Gridnev and Porvenkov based on probabilistic spectrum analysis, but no specific advice on individual resonance properties was given. Christensen and Vistisen observed, based on a study of nine guitars, that the best guitars have the highest quality factors in their first resonance. They also observed that the lowest frequency should be relatively low.

By far the most thorough and conclusive research done on relating guitar quality to measurable quantities was by Meyer. In this work, 15 classical guitars of varying quality were used in a series of subjective and objective tests. The subjective tests consisted of a series of listening tests to different arrangements of music played on each guitar. The objective tests were performed by measuring frequency response characteristics in the SPL due to excitation of the guitars by an electrodynamic vibration system. Measurements were made using microphones in an anechoic chamber with the strings damped. Statistics were then employed to obtain a correlation between measured frequency response characteristics and subjective evaluations of the guitars. It was found that the three most highly correlated measurements with guitar quality were related to the antisymmetric mode of the guitar that occurs at around 400 Hz. This mode is also known as the (0,1) plate mode. Also, the factor with the highest negative correlation with quality was the quality factor in the air mode, meaning the air mode has high damping in guitars of high quality. Based on the results of the correlation tests, Meyer gives specific criteria for quality in acoustic guitars. Among these is the advice that the air mode and the first plate mode should have as much damping as possible, while the antisymmetric mode should have as little damping as possible. Also, the peak levels of the antisymmetric and first plate modes should be high.

Normally, advice on improving quality in guitars is directed at the skilled guitar luthier who achieves such changes passively by careful adjustments of thicknesses and bracing in the guitar. Christensen points out that strong excitation of the (0,1) antisymmetric plate mode is very difficult to achieve since the bridge is usually very close to its nodal line. The closer the bridge is located to the nodal line of a given mode, the less the excitation, of that mode, when the instrument is played.

SUMMARY OF THE INVENTION

There has been a great deal of research in the past in the field of active noise control. Primarily, these efforts have investigated the use of loudspeakers to create anti-noise to cancel out ambient noise, the objective being a lower overall noise level. More recently, work has been done on directly controlling acoustically radiative structures using either attached or integrated actuators with the goal of reducing the radiated sound of the structure. The structures under study have been the building blocks of aerospace applications, beams and plates. Most recently there has been some research in controlling structural systems such as acoustically radiative plates backed by a sealed cavity. This has been directed at applications where decreasing noise transmitted into the sealed enclosure was the primary objective. In the vast majority of these efforts involving direct structural actuation of radiative structures, adaptive feedforward control techniques have been used. The advantage of the embodiment of this control technique that is most often implemented is that little information need be known about the system that is being controlled. The disadvantage is, typically, that the speed of the control algorithm is not sufficient to react to broadband disturbances. Much less research using feedback control approaches exists. The advantage of the feedback approach is the ability to react to broadband disturbances. Very little research was found that explored feedback control techniques with direct structural actuation of radiative structures, and only one experimental study could be found that looked at feedback control of broadband disturbances using smart structural actuation, and this considered a plate substructure in a circular duct only. No experimental studies using feedback control of broadband disturbances using smart structural actuation in more complicated problems such as cavity-backed plates could be found.

In the modeling of cavity-backed plates, only limited research addresses the case when the cavity is vented. A vented, cavity-backed plate model describes the important commercial application of acoustic musical instruments. Accordingly, most of the research in this area is directed toward the acoustic guitar. All of the previous research that could be found involves assumptions that neglect near field acoustic radiation due to antisymmetric plate modes. This is too limiting in investigating musical quality in these instruments. No research could be found on structural/acoustic control of vented, cavity-backed plates. Moreover, although active structural/acoustic control has the potential to favorably tune many of the most important factors that determine quality in acoustic guitars, no published research was found that investigated its application to guitars or any other acoustic musical instrument.

The control objective in all the research found involving acoustically radiative structures was noise suppression. No research could be found in which structural/acoustic control was used to purposely enhance, as well as suppress, aspects of structurally generated acoustics.

Among available transducer devices for structural/acoustic control, surface-bonded piezoceramics have recently found application, buoyed by their success in vibration control applications, as both sensors and actuators. The published models that describe the interaction between structures and piezoceramics can be grouped into two broad categories: continuous models and discrete models. The continuous models have the advantage of a relatively low order state space model that is suitable for control formulation but are severely limited in the complexity of the problem they can solve. The discrete models usually take the form of a piezoceramic or a composite piezoceramic/structural finite element. The powerful finite element method (FEM) approach has the advantage of being able to model very complex structural systems, but the disadvantage of a very high order model not suitable for control formulation or specialized finite elements that are not necessarily available in commercial codes. In addition, most of the models available, discrete and continuous, are directed toward beam and plate problems. There is much less research available directed at more complicated structures such as the vented, cavity-backed plate problem, and no research could be found that addressed modeling of the vented cavity-backed plate problem with actuators of any kind. Also, no research could be found that used the discrete method to solve plate substructure or more complicated structural problems in conjunction with a specific control formulation.

To address some of the unresolved areas in the research mentioned above, three specific studies were defined along with experimental validation. First, a spatially-continuous model of a vented, cavity-backed plate was developed to investigate structurally generated acoustics from the plate and cavity vent. This model includes the effects of both symmetric and antisymmetric modes. Second, a spatially-discrete model of the vented, cavity-backed plate, also including the effects of both symmetric and antisymmetric modes, was developed that includes a hybrid approach to modeling piezoceramic sensors and actuators. This approach allows the use of commercial FEM codes to analyze the structural part of the problem and uses those results along with modal superposition to formulate a reduced order state space model of the cavity-backed plate. The order is reduced with respect to that of the FEM solution. Finally, using the state space model, two feedback control approaches were developed with the control objective of matching the acoustic characteristics of a given structure to those of a target structure with desired acoustic properties, or acoustic replication. This involved the purposeful enhancement as well as suppression of various aspects of the structurally generated acoustics due to a transient excitation. The models and the control approach were also specialized for the commercial application of the acoustic guitar and for an aircraft cockpit. Experimental confirmation of the developed theory was shown in both applications.

Various additional objects and advantages of the present invention will become apparent from the detailed description, with reference to the accompanying drawings.

DETAILED DESCRIPTION OF THE PREFERRED EMBODIMENT

One potential application of the present invention is the acoustic guitar. This instrument displays the structurallacoustic behavior modeled, and research has been done to quantify specific frequency response characteristics which differentiate instruments of very high quality. In addition, the guitar is exceptionally suited as a test specimen. The flat top plate is responsible for most of the sound produced in the low frequency region, and it is extremely amenable to the incorporation of piezoceramic sensors and actuators. Finally, a test specimen was relatively inexpensive and readily available from the manufacturer. In this chapter, the continuous and discrete models are used to predict the passive guitar acoustic behavior due to a shaker and piezoceramic actuator input, respectively. Some specific control objectives are gleaned from the aforementioned previous research for implementation on the test guitar, and the discrete model is used to demonstrate both state variable control and classical frequency response-based control. The experimental control validation is then performed including open- and closed-loop structural and acoustic control results.

The present invention is also applicable to other stringed instruments such as the violin, cello, bass, piano, and others which use, for example reeds, etc. This list is not meant to be exhaustive and no limitation on the use of the invention is to be implied. The invention also includes means for adjusting the various components described herein while the instrument is being played, such as, for example a dial or sensor to adjust the gain.

Figure 1:
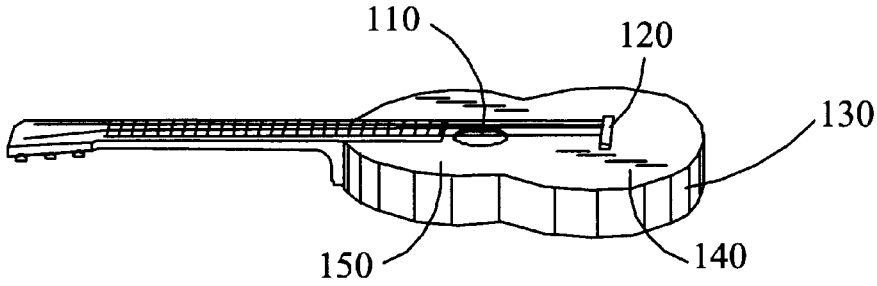
FIG. 1 is a perspective view of a typical acoustic guitar illustrating the guitar nomenclature and geometry.

Several geometric and frequency response-based measurements were taken from the guitar test specimen as inputs into the models. The guitar used was a relatively inexpensive model, a Fender Gemini II folk guitar. FIG. 1 shows the guitar nomenclature and geometry. As shown in FIG. 1, the guitar comprises a rose 110, a bridge 120, ribs or siding 130, a lower bout 140 of the top plate, and an upper bout 150 of the top plate. The continuous model was useful because it provided a closed-form solution to predict the passive behavior of the guitar in response to a shaker input. The goal of the discrete model was to also predict passive behavior of the guitar but primarily to study open and closed-loop control behavior, since this model included piezoceramic sensors and actuators.

Figure 2:
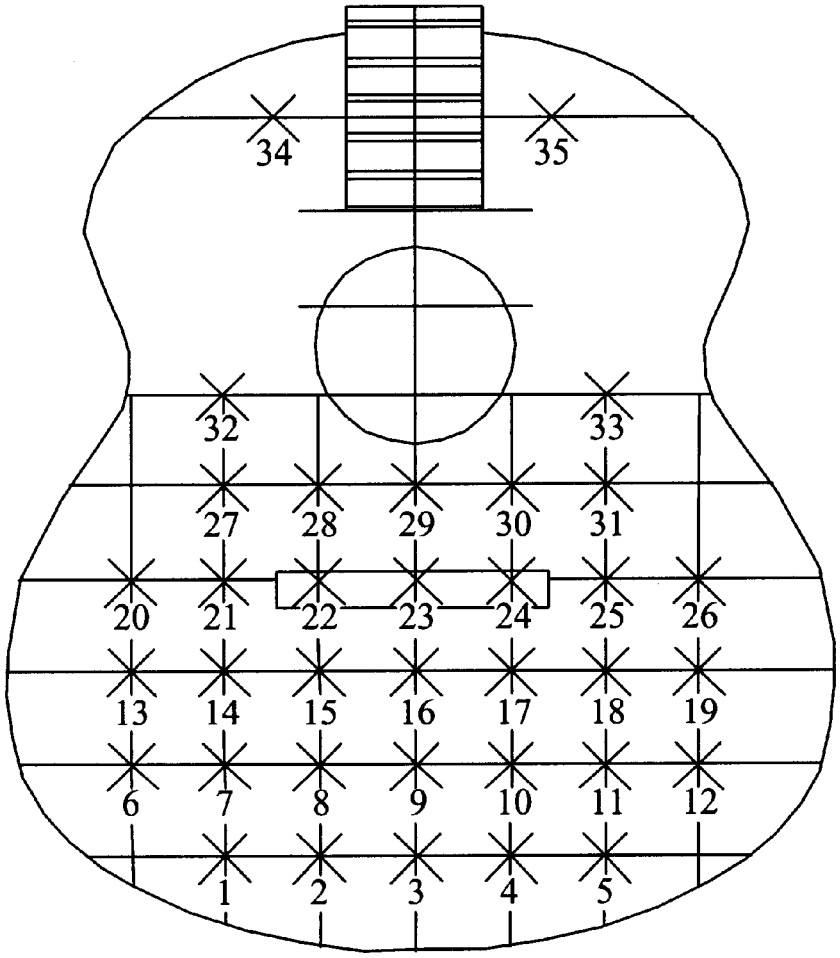
FIG. 2 is a diagrammatic view showing the location of guitar vibration sensors.
Figure 3:
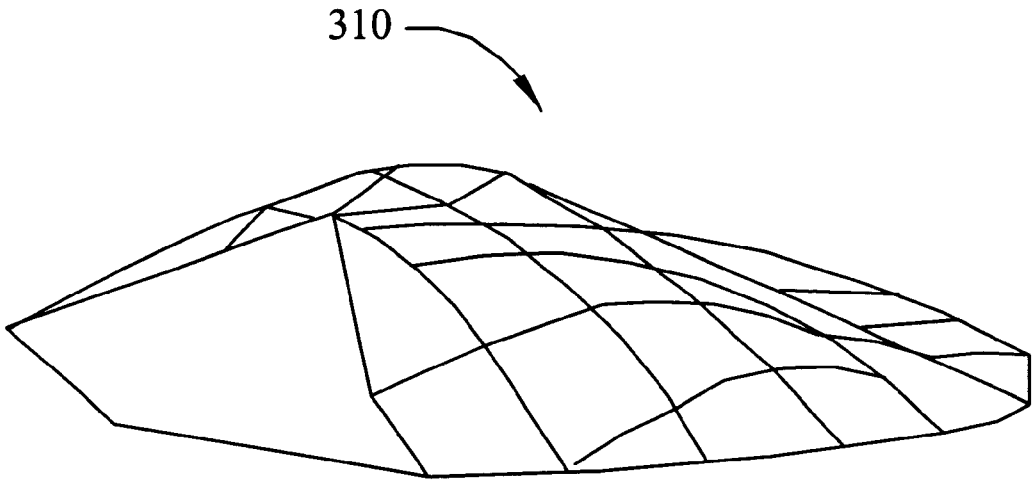
FIG. 3 is a diagram of the first and second plate mode shapes.
Figure 3:
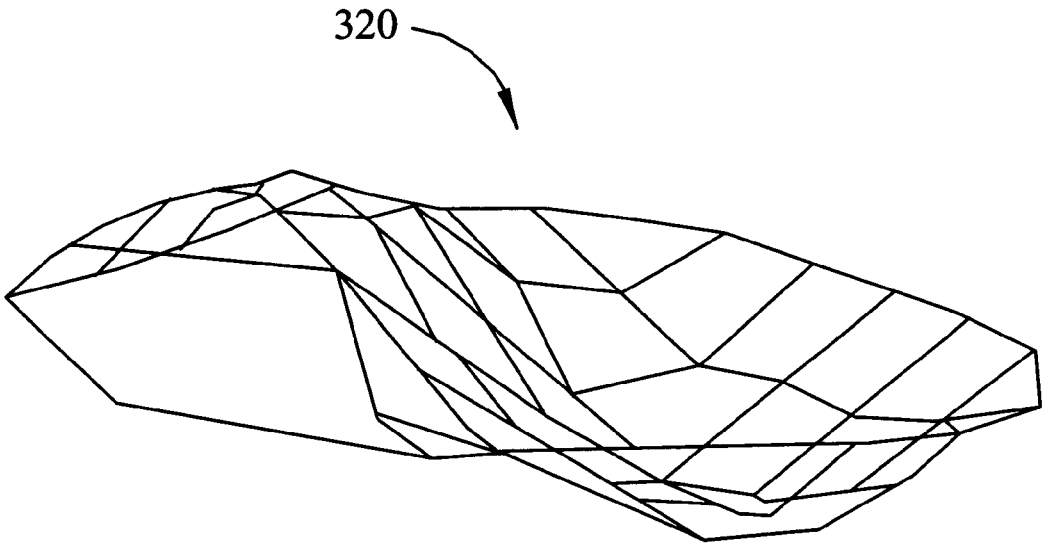

An initial modal survey was done using a Genrad model 2515 computer-aided test system to extract experimental mode shapes. A PCB 086C20 impulse hammer was used at 35 locations with a PCB 303A03 accelerometer in a location that was expected to have a significant participation from both structural modes. The accelerometer location was location 17 in FIG. 2 which shows all locations used in the modal survey. The accelerometer weighed 2 grams, which was considered negligible compared to the mass of the guitar top plate. In all experimental measurements on the guitar body, the guitar was immersed to the ribs in sand to fix the motion of the back and ribs. The first three modes in the initial modal analysis were the air mode at 108 Hz, the first plate mode at 206 Hz and the first antisymmetric plate mode at 377 Hz. The first two plate mode shapes 310, 320 that resulted are shown in FIG. 3. In this particular guitar, the antisymmetric mode does not clearly conform to the standard (0,1) plate mode or (1,0) plate mode identified by previous researchers in folk guitars, but the procedure for modeling an antisymmetric mode is similar in any case. This antisymmetric mode is acoustically important in this guitar as will be evident in its contribution to the measured SPL. The movement of the top plate at the air mode frequency was almost identical to the first plate mode 310 but at a much lower amplitude.

Figure 4:
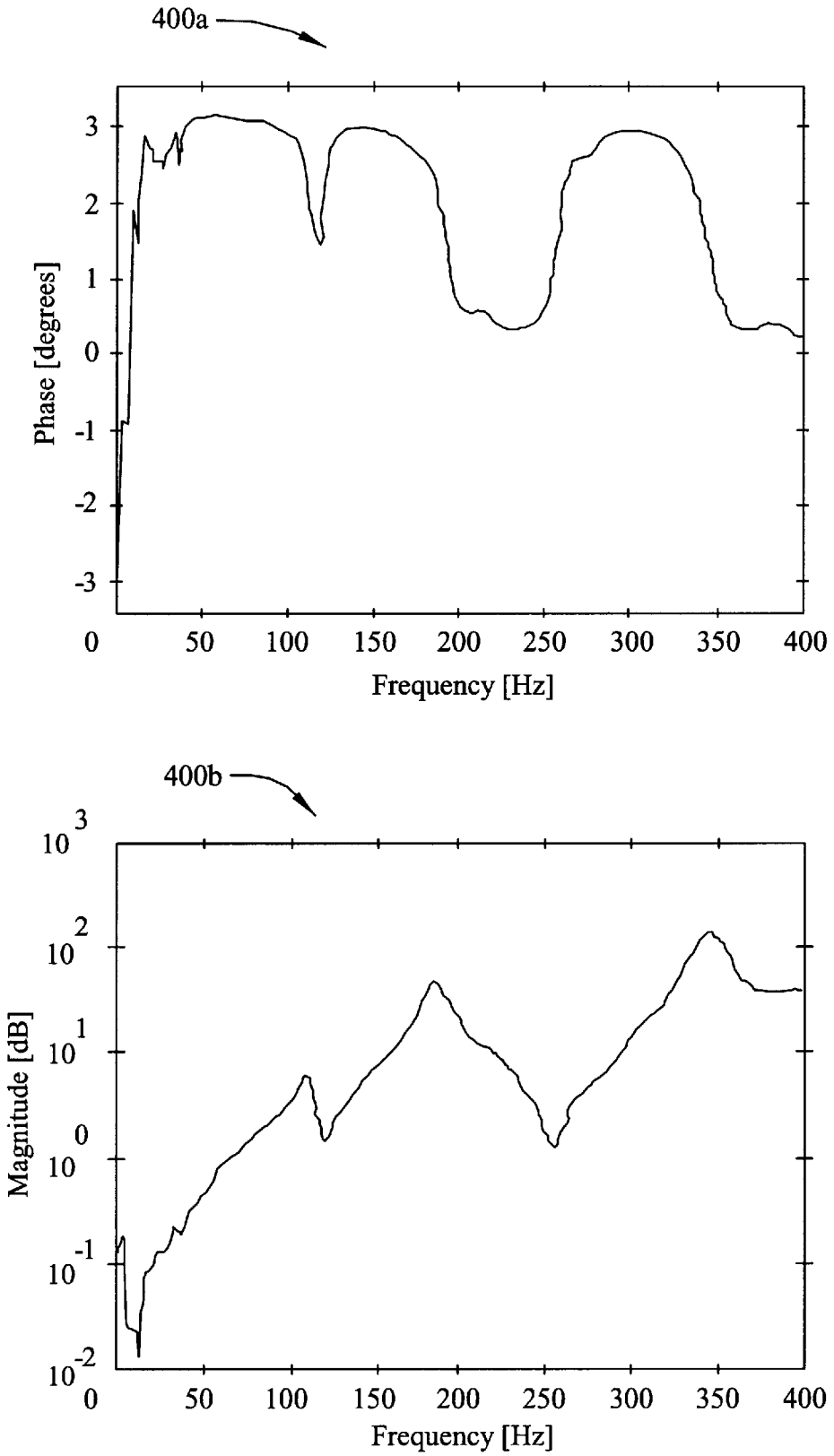
FIG. 4 illustrates two graphs of typical measured accelerance transfer functions.

Since a shaker input force applied to the guitar body was necessary to create an easily measurable SPL, an additional modal survey was done to verify that the mode shapes of interest did not change significantly under different forcing conditions. This modal survey was done using a Bruel and Kjaer type 4810 mini-shaker as the input force and the same accelerometer at the 35 measurement locations. The shaker was attached to the guitar near an antinode of the 2nd plate mode 320 to insure its contribution in the measured transfer functions (position 18 in FIG. 2). The first three mode shapes were virtually identical to the initial modal survey, although the frequencies shifted somewhat due to the added mass and stiffness of the shaker shaft and the force transducer. The air mode shifted up to 110 Hz while the first and second plate modes 310, 320 shifted down to 186 Hz and 344 Hz, respectively. A typical accelerance transfer function 400*a*, 400*b* is shown in FIG. 4. The accelerance transfer function 400*a*, 400*b* is defined as the Fourier transform of the acceleration of the structure at the measurement point divided by the Fourier transform of the force input to. the structure at the excitation point.

Inputs to the continuous and discrete models from physical measurements on the guitar were $\rho$, V, $S_h$, $r_h$, and t. Parameters that were dependent on ambient conditions were $\gamma$, $\rho_0$, $P_0$, and $a_0$. Additionally, the measured values $\omega_h'$, $\omega_1'$, $\omega_2'$, $\xi_h'$, $\xi_1'$, and $\xi_2'$ were taken from the experimentally obtained accelerance transfer function using Modal-plus software by SDRC. Finally, the angle of the nodal line of the second plate mode 320 (FIG. 3) is at an angle $\theta$ with respect to the symmetric line of the guitar. This was also determined experimentally from the initial modal survey and input into the model. Physical measurements used to derive model inputs are recorded in Table 1.

The assumption, in the models, that the cavity dimensions were less than $\lambda/2$ was violated for the antisymmetric plate mode since the longest cavity dimension of 0.50 meters was greater than the 0.49 meter value of $\lambda/2$, corresponding to the antisymmetric plate mode frequency of 344 Hz. This violation was allowed based on further investigation of the restriction. The $\lambda/2$ limit was imposed to avoid the first cavity resonance that occurs in an ideal duct at this frequency. The guitar body is not an ideal duct but has a varying geometry. Measurements of the first duct resonance made on a Martin D28 folk guitar, which is similar in geometry and has the same longest cavity dimension as the guitar under test, showed that the first duct resonance did not occur until 383 Hz. Additionally, even though the Martin D28 guitar had an antisymmetric plate mode shape that closely matched the pressure variation in the first cavity resonance, the coupling was considered weak. In the case of the guitar under test, the mode shape of the antisymmetric mode is markedly different from that of the cavity resonance and occurs at a lower frequency than the actual duct resonance frequency, so coupling was ignored.

Figure 5:
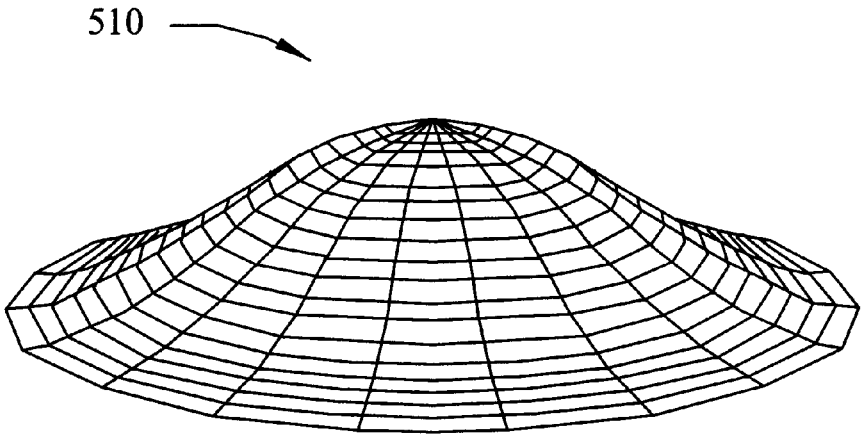
FIG. 5 illustrates the shape functions for the assumed plate.
Figure 5:
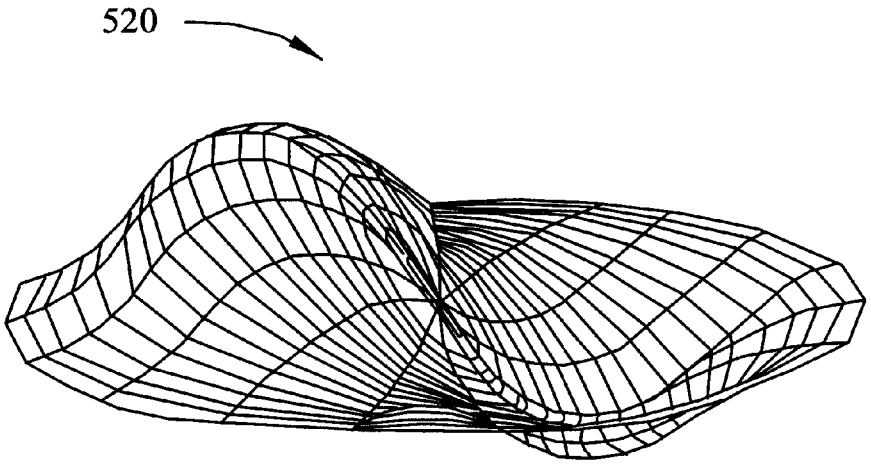

An equivalent, clamped circular isotropic plate was used to model the motion of the lower bout of the guitar. The actual boundary conditions on the guitar lower bout are somewhere between clamped and simply supported but reasonable agreement between experiment and theory has been shown by past researchers using the clamped condition. FIG. 5 shows shape functions 510, 520 for the assumed plate. These can be compared to the actual measured mode shapes in FIG. 3. Lower bout movement is thought to be responsible for most of the sound output of the guitar in the low frequency range. This type of movement, for low frequency function, has been verified experimentally. Depending on the type of guitar, the back plate may also have significant motion in lower frequency function. This can easily be included in the transfer function analysis by considering it as a plate in the same manner as the lower bout. However, prediction of SPL would require a different approach. This research considers only top plate motion. The experimental verification accounted for this by imposing a fixed boundary condition on the back.

Figure 6:
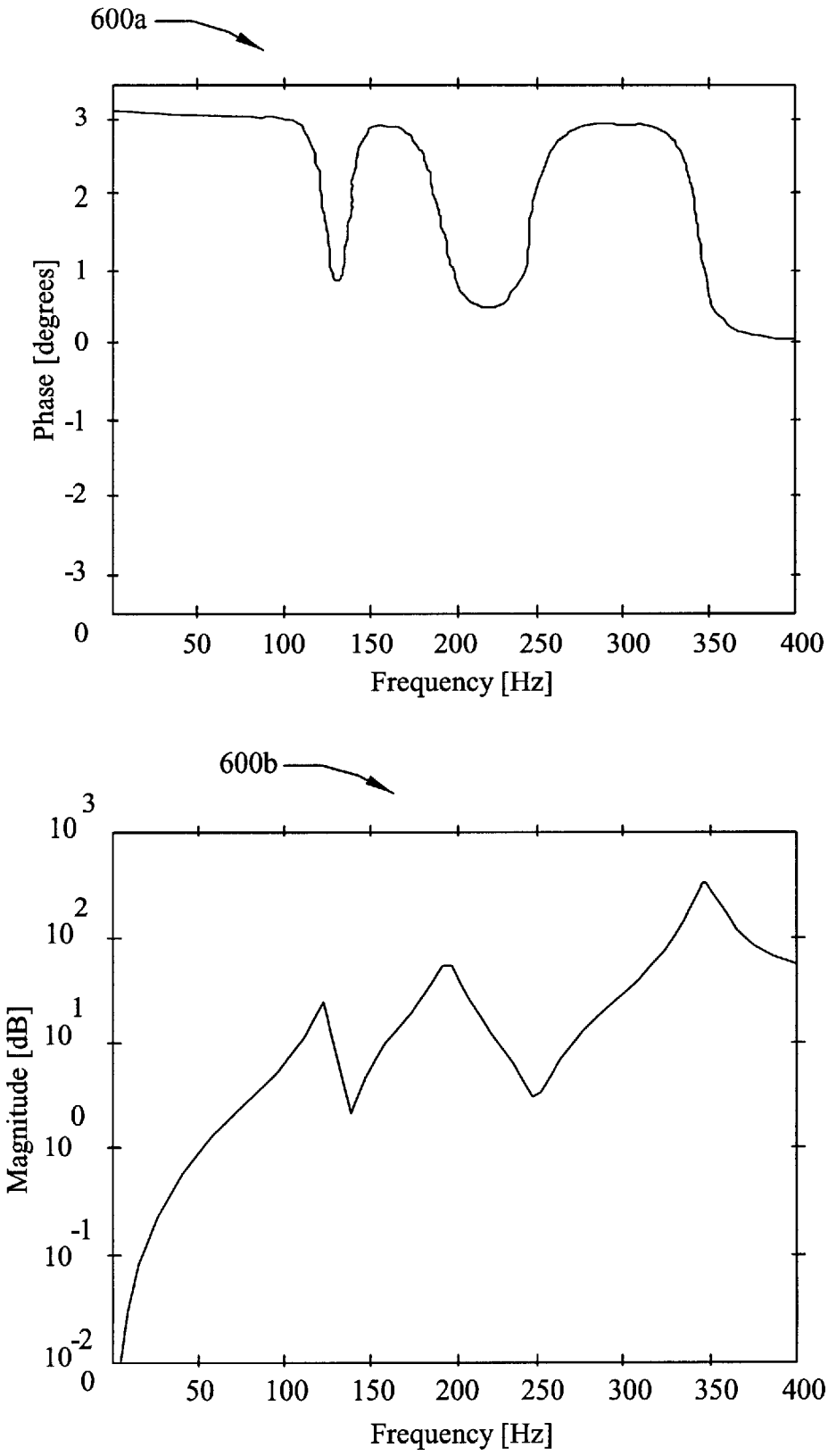
FIG. 6 is two graphs of the predicted accelerance transfer function.

The diameter of the equivalent isotropic plate was determined by averaging the widest point of the lower bout with the distance from the bottom of the guitar to the bottom of the rose. It was assumed that the undamped natural frequency, $\omega/2$, was equal to the measured value of the $\omega/2'$ since the second plate mode has low damping and is not well coupled to the air mass. The first plate undamped natural frequency is then derived using the relationship for a circular isotropic plate of $\omega_1=\omega_2{}^{1.015^2}/_{1.468^2}$. The values for $R_1$ and $R_2$ were also assumed to be equal to the measured values of $R_1'$ and $R_2'$ where $R=\rho\omega\xi$. After substitution of the measured parameters, numerical solution of Equations 2.11 gave the accelerance transfer function 600*a*, 600*b* shown in FIG. 6. This corresponds to the accelerometer and shaker positions used in the experimental measurement in FIG. 4. The agreement between accelerance transfer functions was reasonable considering that no parameters were adjusted to match the two. The relative values of the peaks, with respect to each other, were consistent with experiment, and the way their relative contributions changed as a function of plate location was also consistent with experiment as witnessed by the similarities between the measured mode shapes and shape functions.

Pressure measurements were made in an anechoic facility 710 (FIG. 7) with the guitar submerged up to the ribs in its sandbox 720 and placed on a large wooden baffle. The dimensions of the anechoic facility 710, inside the foam 730, were approximately 5 m×5 m×6 m. The microphone 740 used was built into a Tandy 33-2050 sound level meter. It's frequency response was flat from 32 to 10,000 Hz (±3 dB). The guitar was excited by the suspended minishaker 750 with the accelerometer 760 and shaker 750 fixed in favorable positions, 17 and 18 in FIG. 2, respectively, to measure and excite the first and second plate modes 310, 320 (FIG. 3) as found in the second modal survey. Pressure was measured at observation points in front of the guitar using a microphone 740 mounted on a tripod 770. Pressure level measurements were made as a result of input excitation by the shaker 750 driven by an amplified pink noise source. The averaged transfer function with the microphone as the output and the minishaker 750 attachment point force transducer 780 as the input was computed. This gave the average pressure at the observation point for a given averaged force input as a function of frequency. From this, SPL was computed for a 1 N force input to compare to predicted pressure values.

Figure 7:
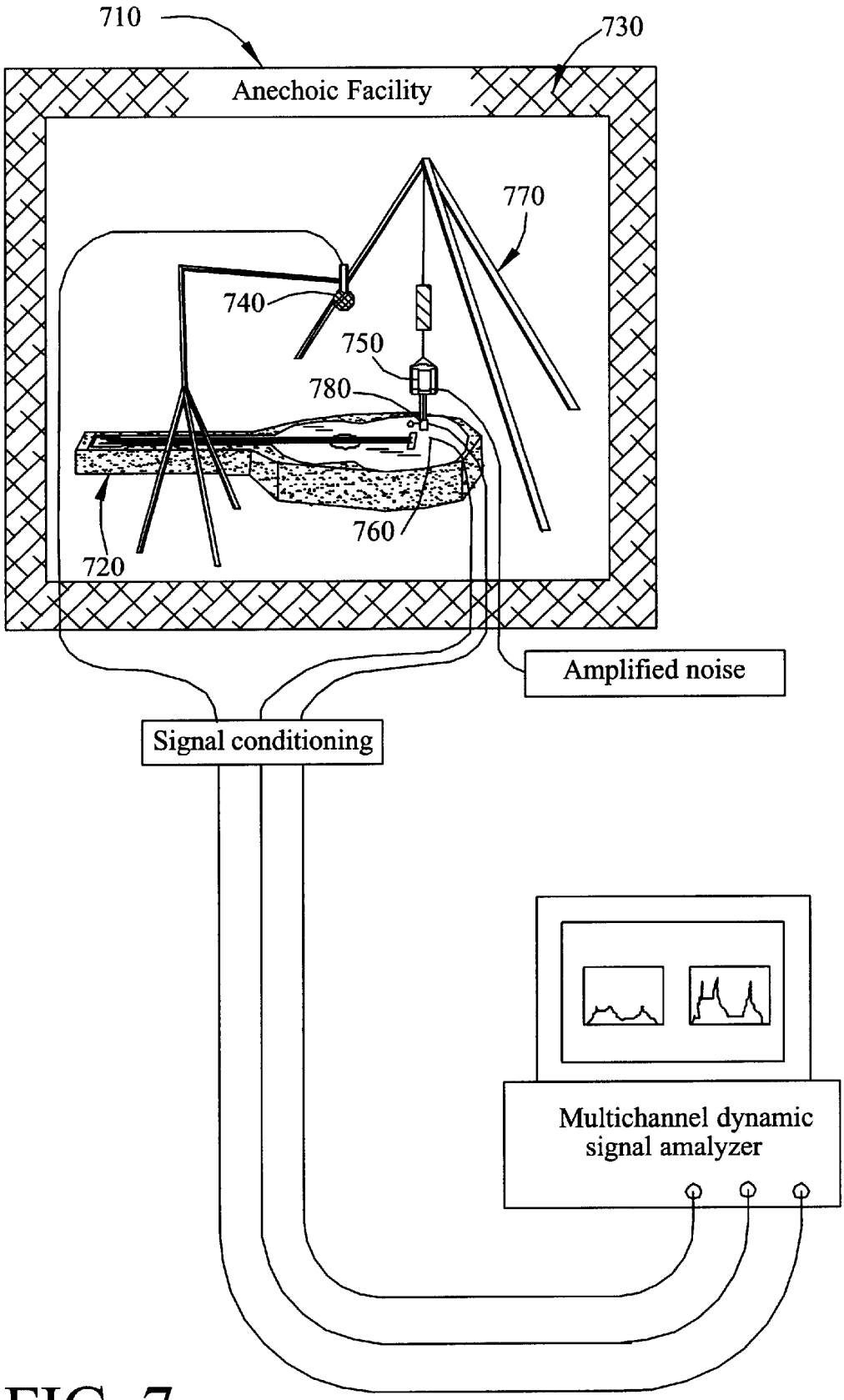
FIG. 7 is a schematic diagram of the experimental setup used to measure sound pressure.
Figure 8:
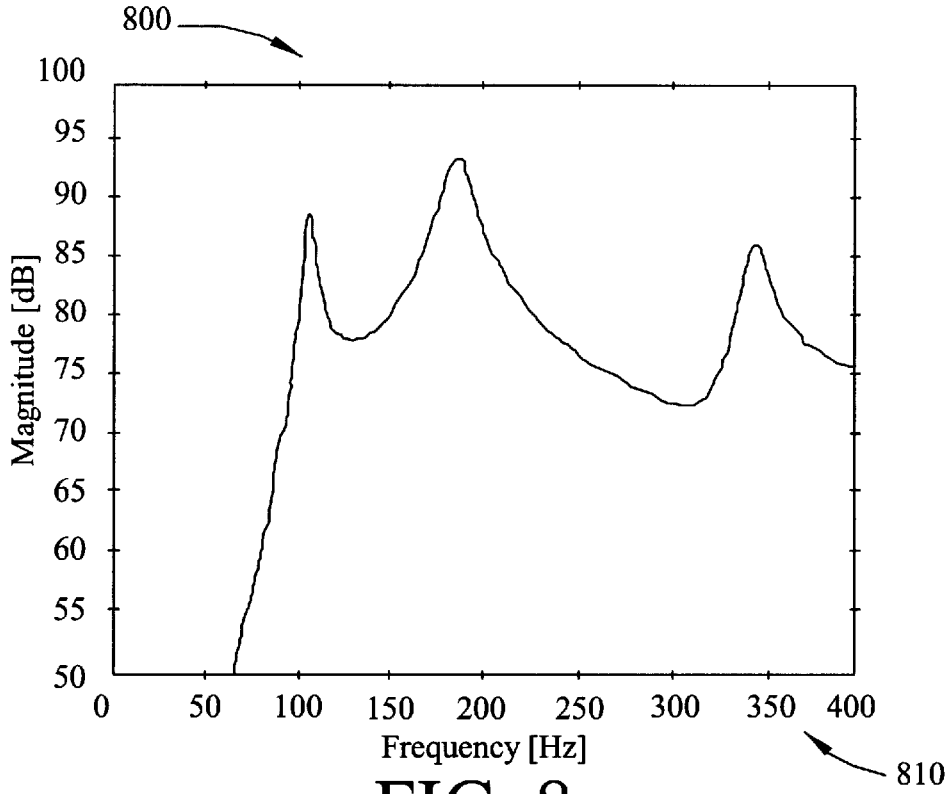
FIG. 8 is a graph of the predicted sound pressure level.
Figure 9:
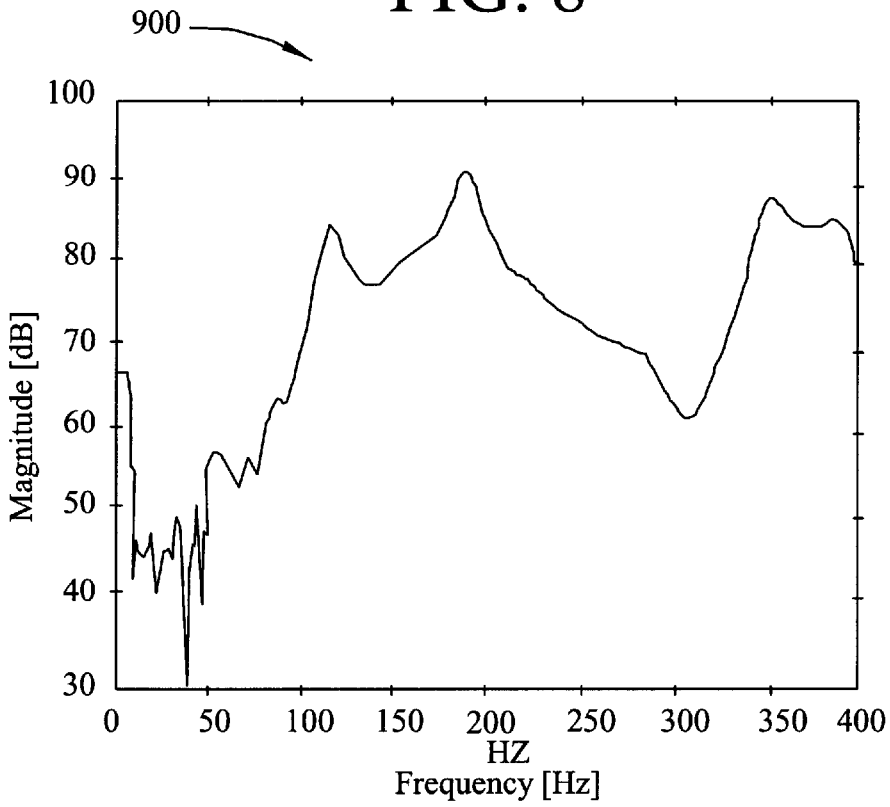
FIG. 9 is a graph of the measured sound pressure level.

FIG. 7 shows a schematic of the experimental setup used to measure sound pressure. FIG. 8 shows the predicted SPL 800 for a 1 N force input at each frequency 810 from the solution of Equations 2.11 and the use of the Rayleigh integral developed in Chapter 2. FIG. 9 is the measured SPL 900 for an averaged 1 N force input at an observation point 50 cm above and 35 cm to the right of what was judged to be the center of the lower bout. The center of the lower bout was determined to be the point where the nodal line of the measured second plate mode 320 (FIG. 3) crossed the guitar's plane of symmetry. This point is approximately halfway between locations 16 and 23 in FIG. 2. The observation point was expected to have a pressure level contribution from both the first and second plate modes 310, 320 (FIG. 3) and the air mode. The measured SPL 900 shows a mode slightly higher in frequency than the second plate mode 320 (FIG. 3) at 381 Hz. This mode was also measured in the modal analysis but was not included in the model. Otherwise, the trends of the two SPL measurements 800 (FIG. 8), 900 (FIG. 9) match reasonably well.

Figure 10:
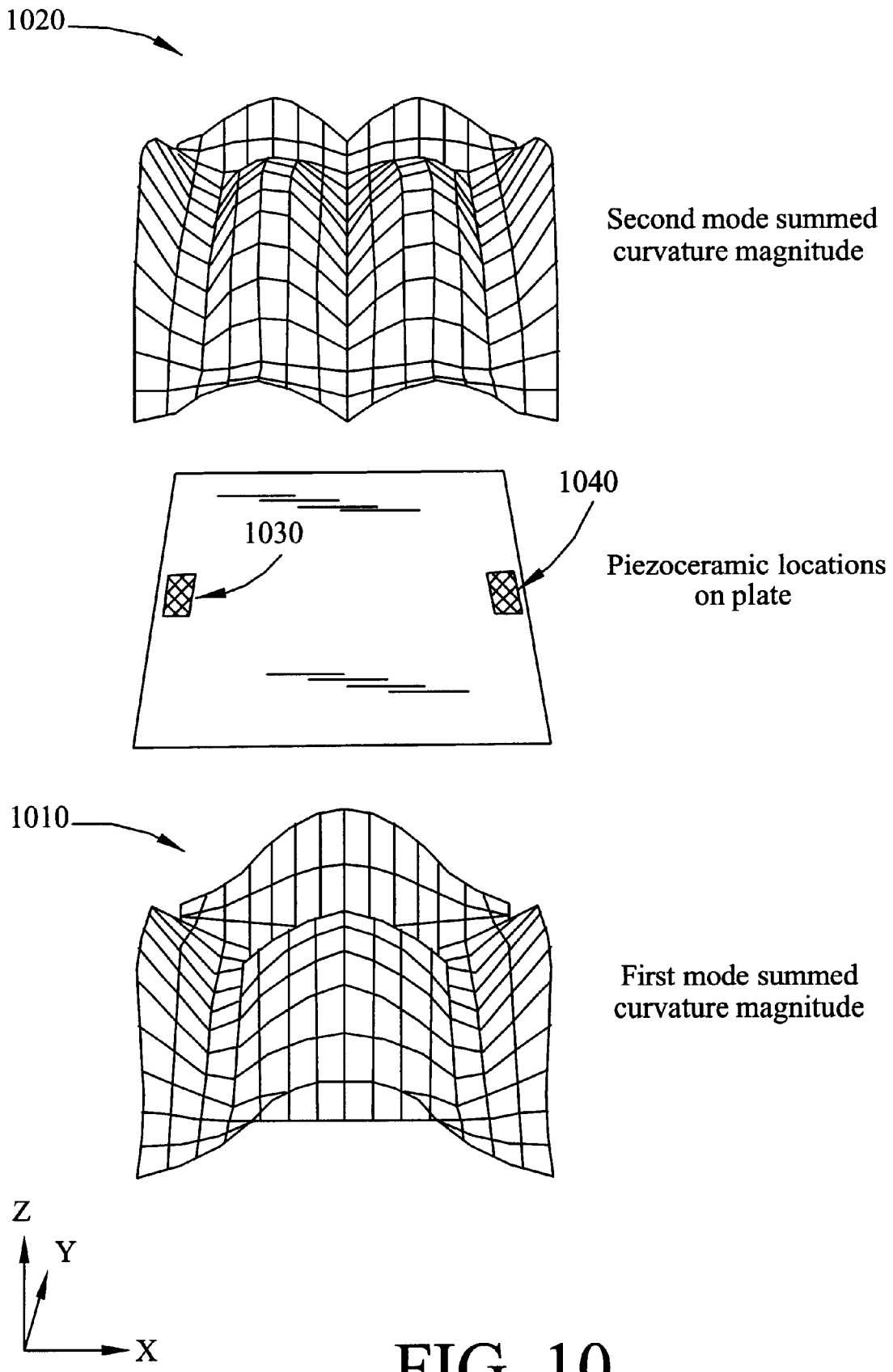
FIG. 10 is a diagram showing the location of piezoceramic sensors and actuators and graphs of the first and second mode summed curvature magnitudes.

For the discrete model, a rectangular shape was selected for the equivalent plate representing the lower bout. This facilitated the incorporation of piezoceramic sensors and actuators since they are readily available in rectangular shapes. A location 1030, 1040 (FIG. 10) of the sensors and actuators was sought that coupled them well with the both the first and second plate modes 310, 320 (FIG. 3). Using the criteria established in Chapter 3, a graph of first and second mode summed curvature magnitude 1010, 1020 from the approximate solution of Young for the clamped, rectangular plate is shown in FIG. 10. Without going through a formal optimization process, the figure shows that the selected locations of the piezoceramics have a high contribution of summed curvature from both the first and second mode.

Figure 11:
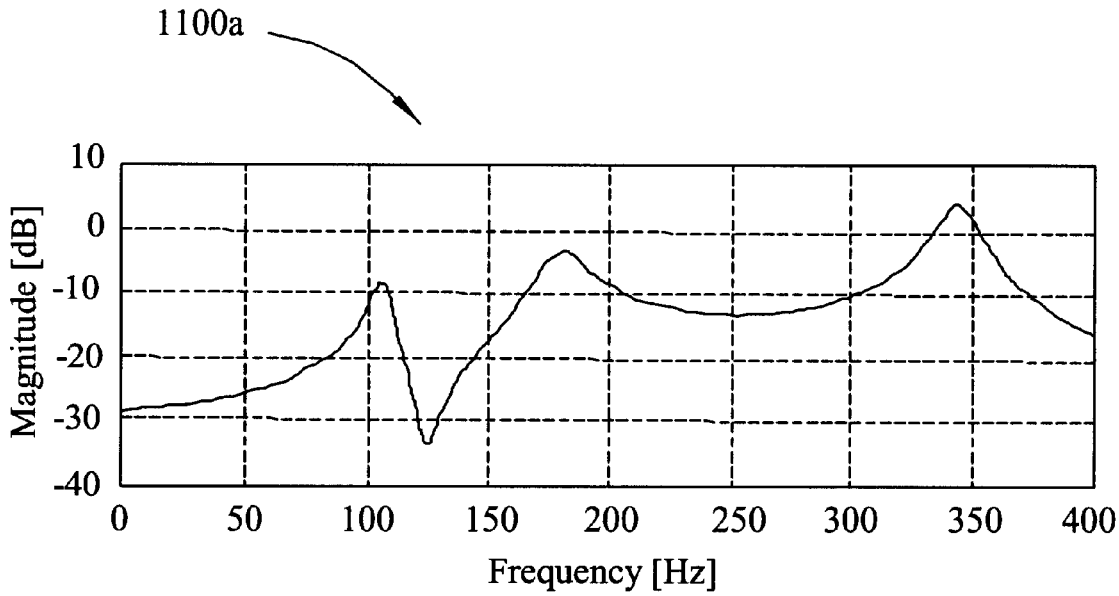
FIG. 11 shows graphs of the predicted transfer functions.
Figure 11:
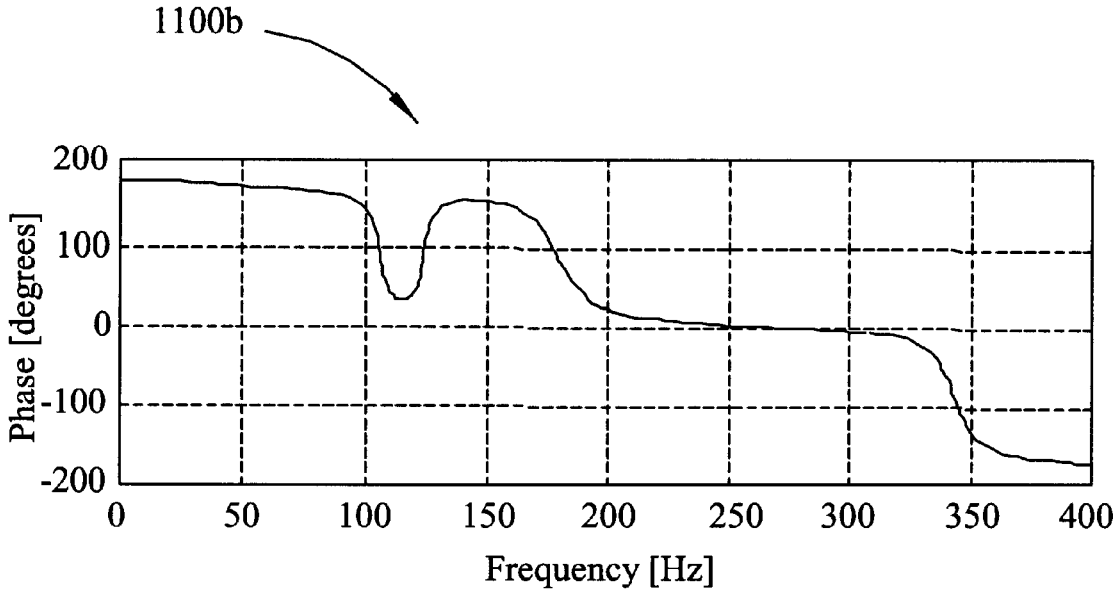

A finite element model was constructed to solve Equation 2.18. Guitar model inputs which are specific to the finite element model are also in Appendix C. It was assumed, as in the continuous model that $\omega_2$ and $\xi_2$ were equal to the experimentally measured values. A frequency independent value for the air mode damping was sought to allow the use of the state space formulation. To get the relationship between the measured parameters $\omega_1'$, $\xi_2'$, $\omega_h'$, and $\xi_h'$ and the corresponding equation parameters, the coupled oscillator approach of reference was used as given by $$\gamma_1' = \left[\frac{1+G}{2G}\right]\left\{\gamma_1 + \left[\frac{G-1}{G+1}\right]\gamma_h\right\}, \qquad (4.1)$$

$$\gamma_h' = \left[\frac{1+G}{2G}\right]\left\{\gamma_h + \left[\frac{G-1}{G+1}\right]\gamma_1\right\},$$

where $$G = \frac{\omega_1'^2 - \omega_h'^2}{\omega_1^2 - \omega_h^2}$$

and $\gamma=\xi\omega$. Upon entering the model inputs into the state space equations and adding a gain of 100 before the actuator to represent an amplifier, the corresponding predicted transfer function 1100*a*, 1100*b* is given in FIG. 11.

To demonstrate the feasibility of using active control to modify the acoustics of the guitar, some specific control objectives were formulated based on the available literature. The pole placement method and the classical frequency response-based control method were then applied to the discrete model of the guitar including sensors and actuators to achieve the control objectives.

By far the most conclusive studies relating guitar quality to specific factors in frequency response are the references to Meyer and Jansson reference. In it, the single three most important factors which differentiated high quality instruments were all directly related to low damping in the (0,1) antisymmetric plate mode. Another important, potentially alterable factor was the damping in the air mode. This should be made high if possible. It was noted that both the air mode and the first plate mode 310 (FIG. 3) should have higher damping, but that the peak level of the first mode 310 (FIG. 3) should be high. Since damping and peak level are related, this advice may inspire two different objectives depending on the amount of material damping present in the first plate mode 310 (FIG. 3). If the material damping is large enough, the increase in peak level of the first plate mode 310 (FIG. 3) due to a decrease in damping may be beneficial. If material damping is low, an increase in damping may be beneficial. Based on the advice from reference, four specific control objectives were formulated.

1. Decrease damping in second plate mode 320 (FIG. 3).
2. Decrease damping in second plate mode 320 (FIG. 3) and increase damping in air mode.
3. Decrease damping in second plate mode 320 (FIG. 3) and increase damping in air mode and first plate mode 310 (FIG. 3).
4. Decrease damping in first and second plate modes 310, 320 (FIG. 3) and increase damping in air mode.

Although the relative amounts of damping in these first three modes are extremely hard to control through passive means, they are controllable using active methods. Since the string input excitation to the guitar is transient and broadband, the problem is especially suited for active feedback control methods. In the stated control objectives, the amount of increase or decrease is somewhat arbitrary since specific target numbers are not given in the literature. For the pole placement method a decrease or increase of 20% will be sought and all four control objectives will be demonstrated. For the classical frequency response-based method, objective 1 will be demonstrated over a range dependent on control filter gain.

The pole placement technique was carried out with sensor location, actuator location, and other state space parameters as in the discrete model of Section described above. Control objectives 1–4 were implemented by adjusting the real part, $\sigma$, of the poles without adjusting the imaginary part, $\omega$. This had the desired effect of changing the damping without changing the damped natural frequency. For example, the relation between the damping ratio, $\xi$, and the parameters of the complex pole is $$\xi=\cos(\tan^{-1}(\omega/\sigma)).$$

Figure 12:
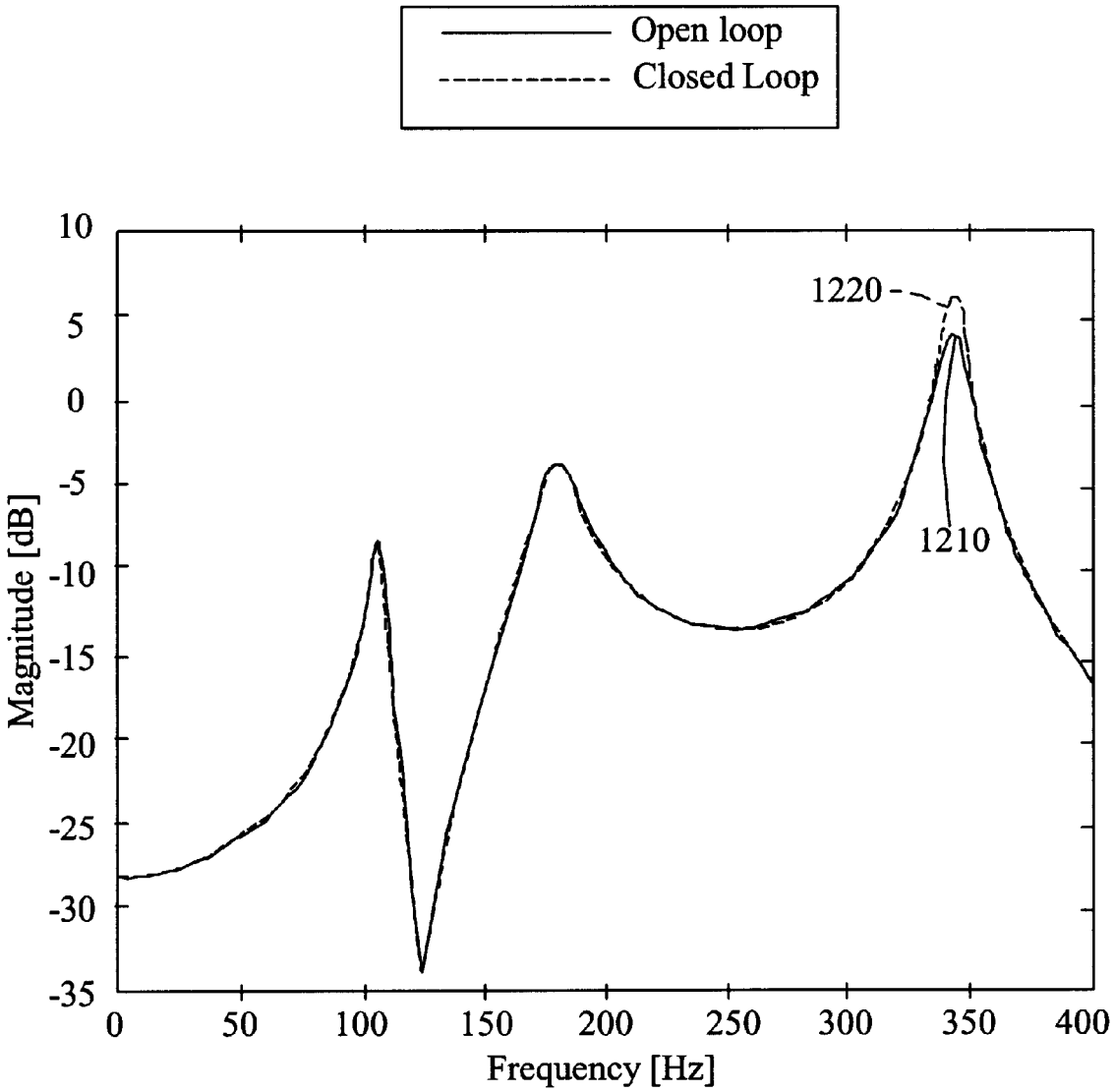
FIG. 12 is a graph of the open and closed loop transfer functions for control objective number 1.
Figure 13:
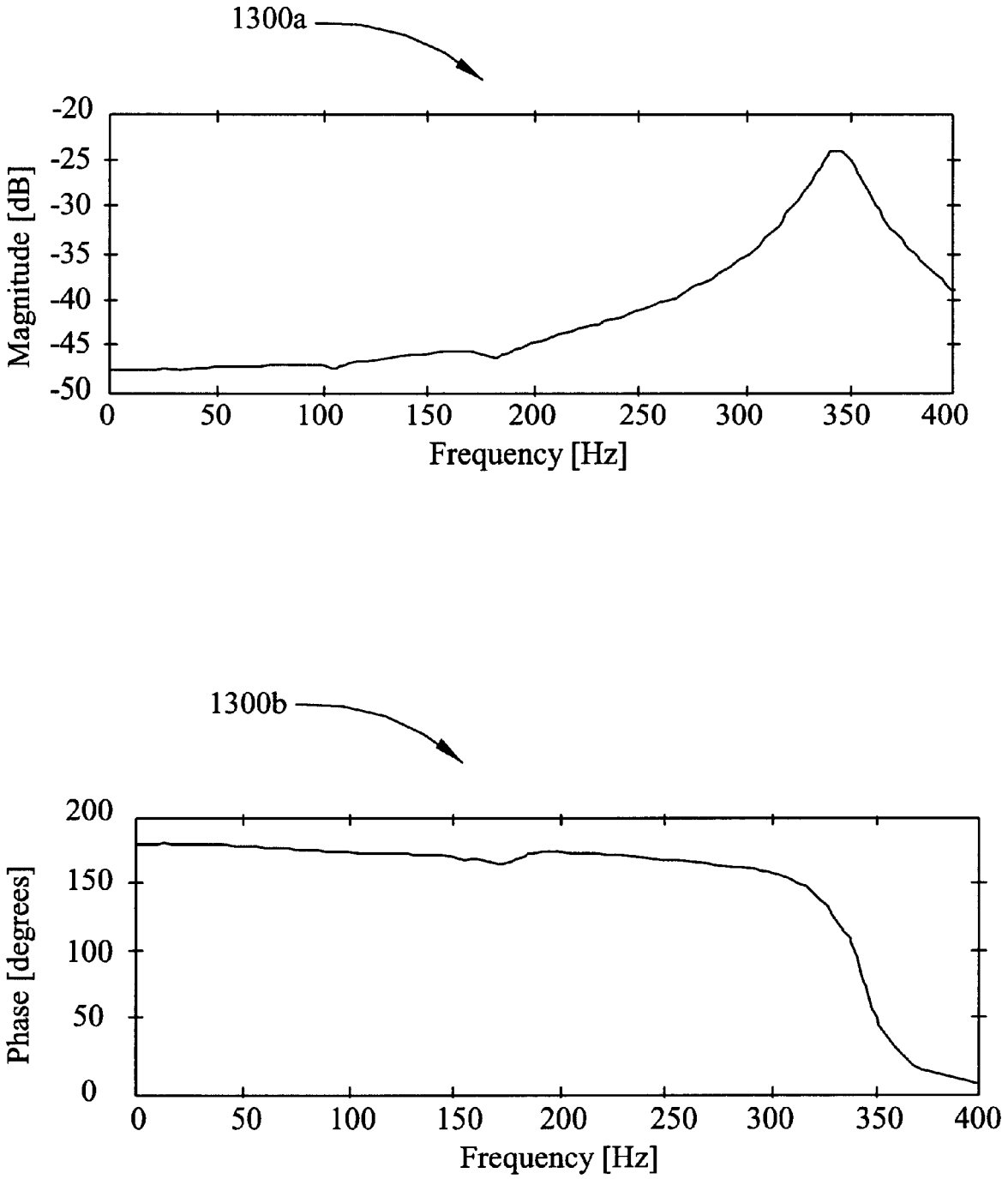
FIG. 13 illustrates graphs of the effective control filter corresponding to FIG. 12.
Figure 14:
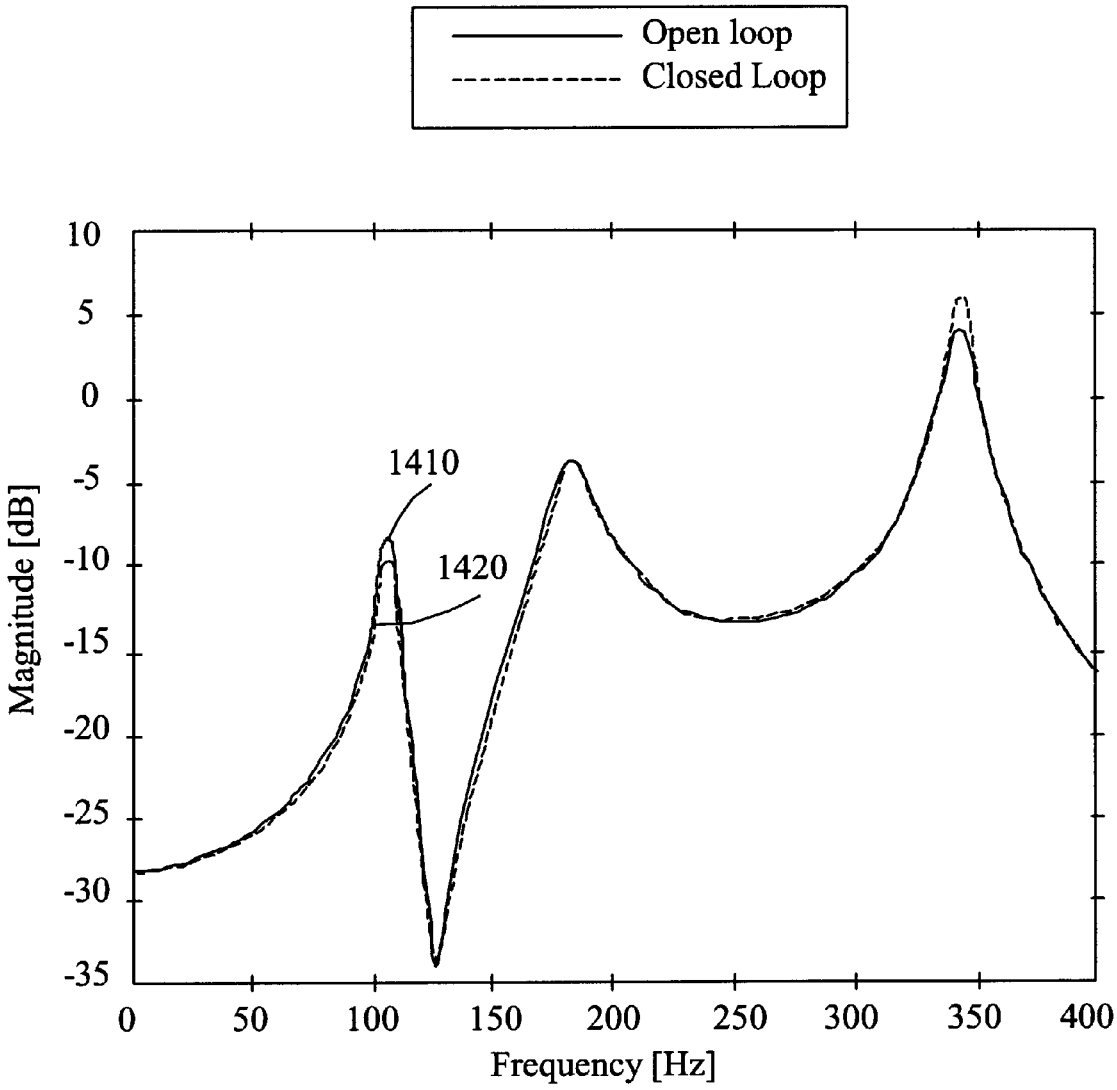
FIGS. 14–16 illustrate graphs of the predicted open and closed loop behaviors of control objectives 2–4.
Figure 15:
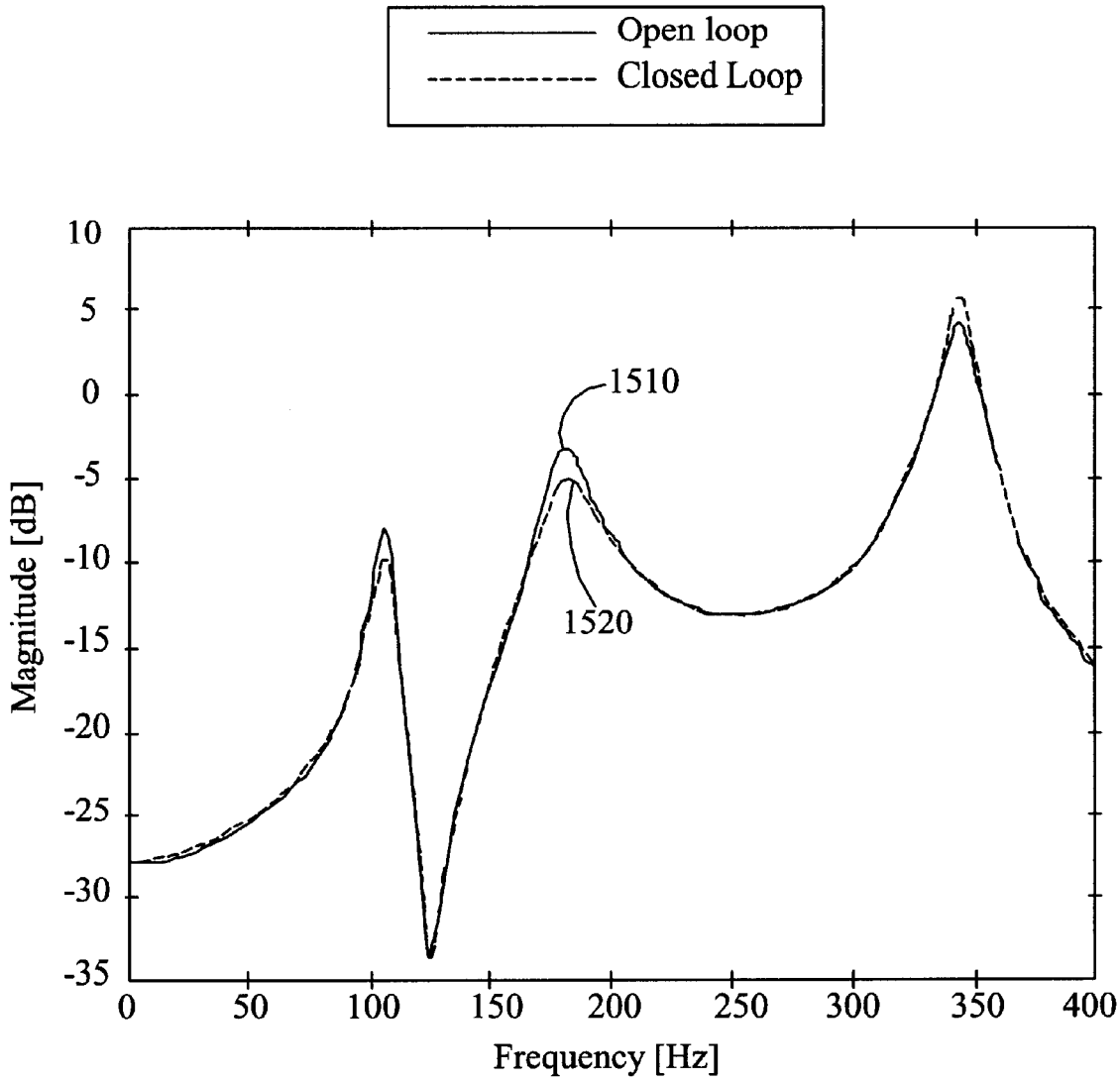
Figure 16:
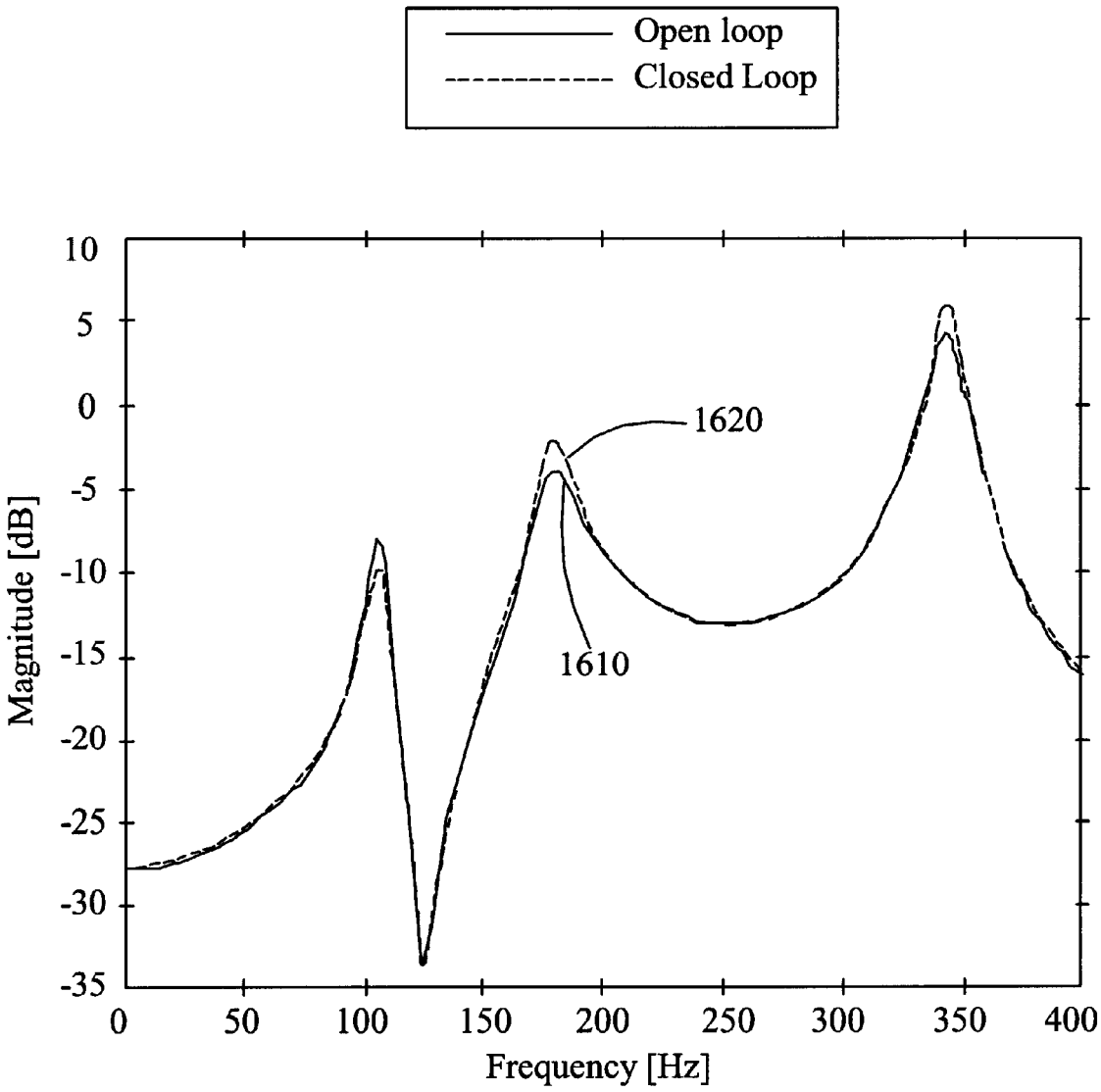

Using this relationship, the first control objective was meant by changing the location of the complex pole pair from −41.4±2159.3 to −33.2±2159.3. This corresponds to a decrease in damping ratio of 20%. The open and closed loop transfer functions 1210, 1220 using pole placement are shown in FIG. 12. In addition, the corresponding effective control filter 1300*a*, 1300*b*, is also shown in FIG. 13. Control objectives 2–4 were realized in the same way. Their predicted open and closed loop behavior 1410, 1420, 1510, 1520, 1610, 1620 are shown in FIGS. 14–16.

Figure 17:
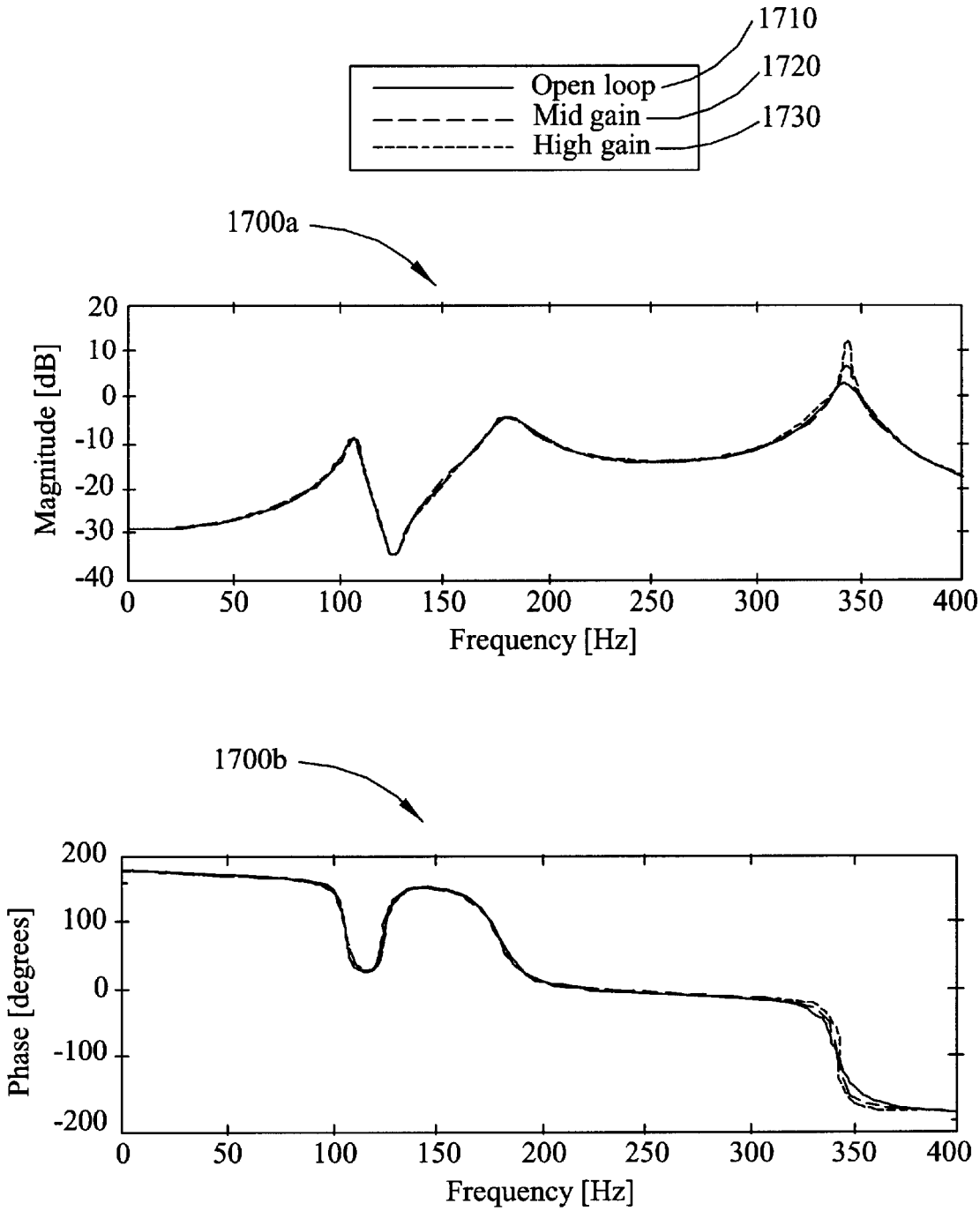
FIG. 17 illustrates graphs of the predicted closed loop transfer function with varying gain values.
Figure 18:
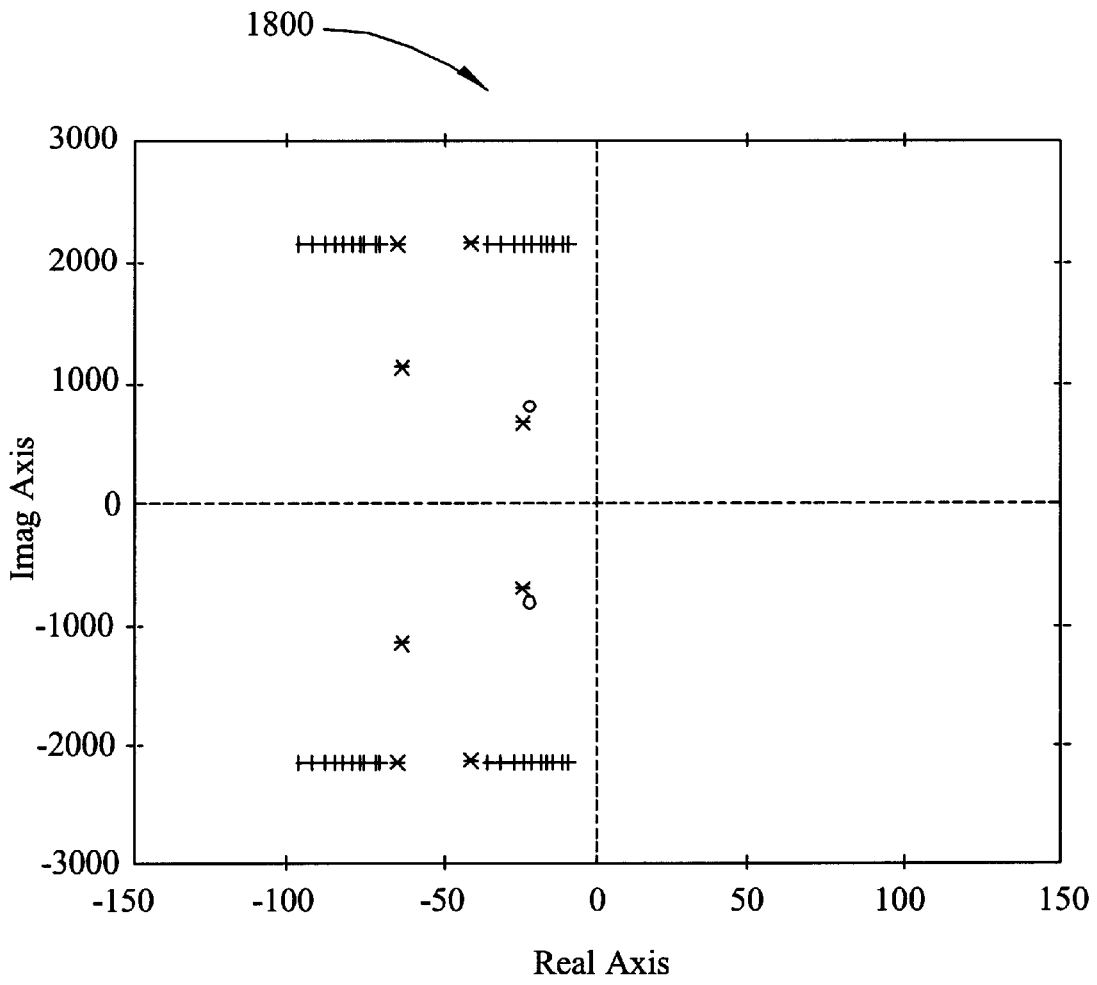
FIG. 18 is a plat of the root locus using a low pass filter.
Figure 19:
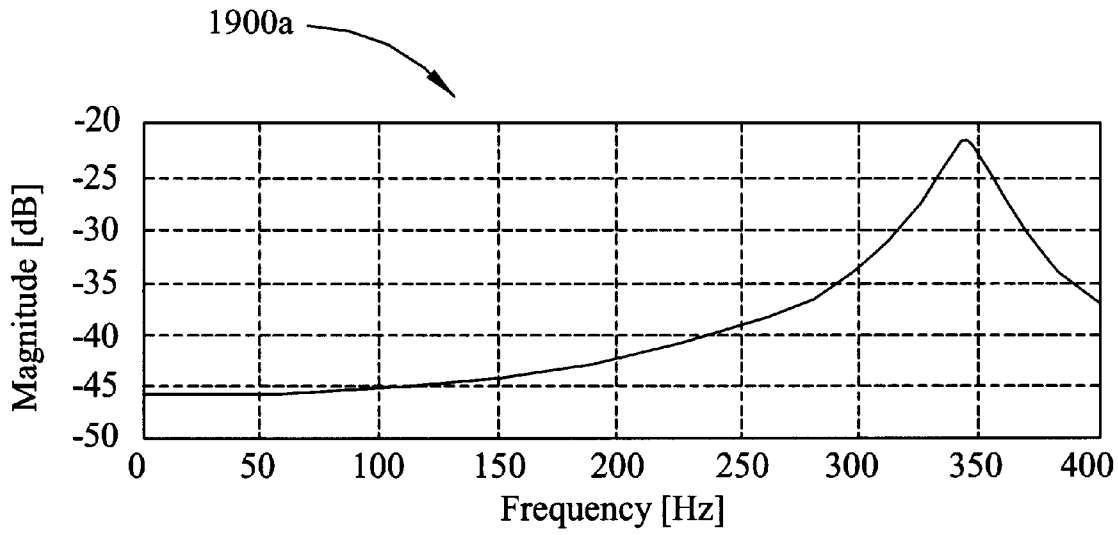
FIG. 19 illustrates graphs of the transfer function of the low pass filter.
Figure 19:
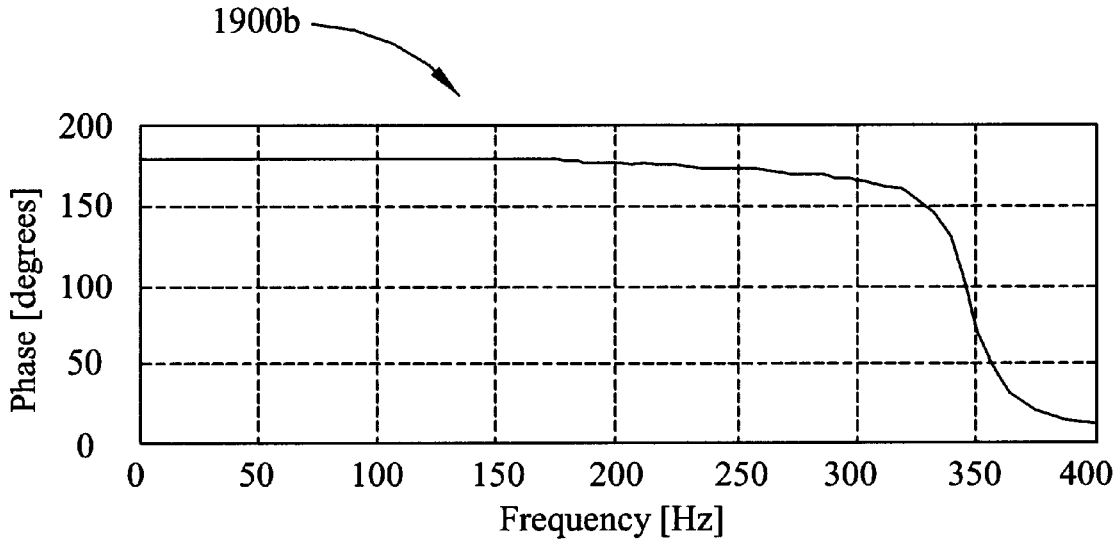

Using the classical frequency response-based methods, control objective 1 was implemented using the low pass filter to take away damping from a mode. This result 1700*a*, 1700*b* is reproduced for varying gain values 1710, 1720, 1730 on the control filter in FIG. 17 along with root locus plots 1800 for the varying gain values in FIG. 18. The transfer function 1900*a*, 1900*b* of the low pass filter, for the lowest gain 1710 in FIG. 17, is shown in FIG. 19. It is interesting to note that for the first control objective, both methods suggest the same form of control filter as can be seen by comparing FIGS. 13 and 19. Also, for all control objectives, as the 2nd plate mode 320 (FIG. 3) decreases in damping, the real part of the pole gets closer to the right half plane in the root locus plot. This illustrates a limitation in the active control scheme. As the pole gets less damping, it is more likely to go unstable.

In order to verify the trend of the open and closed loop predictions, it was necessary to bond piezoceramic sensors and actuators onto the guitar top plate. Final sensor and actuator positions 2010, 2020 (FIG. 20) were found on the actual guitar after doing an additional modal survey with an in-plane sensor. The experimental control was implemented using both the pole placement and the classical frequency response-based design results on a digital signal processing (DSP) board and on a portable, battery-powered, control box.

Figure 20:
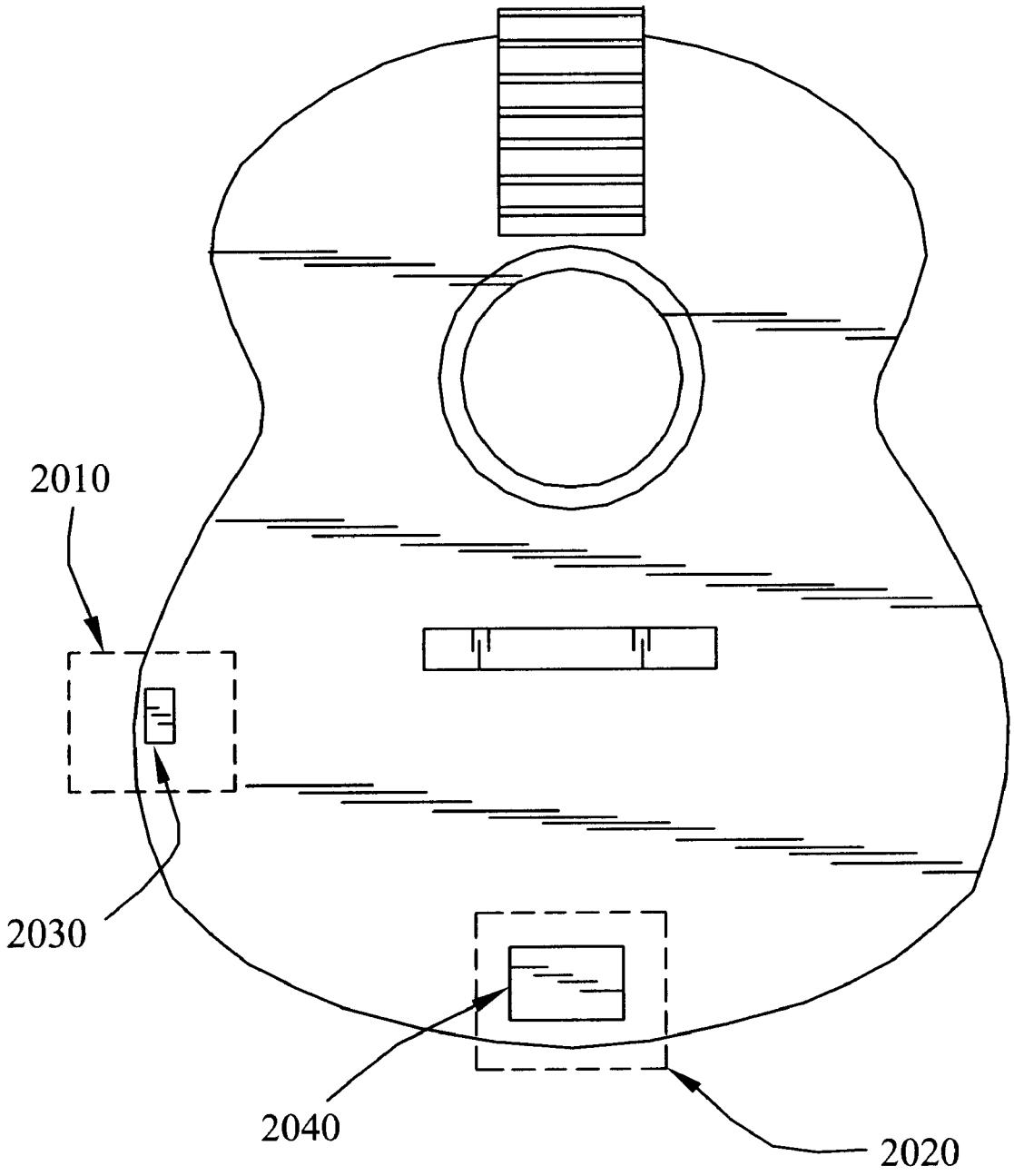
FIG. 20 is a diagram of the final location of the piezoceramic sensor and actuator.
Figure 21:
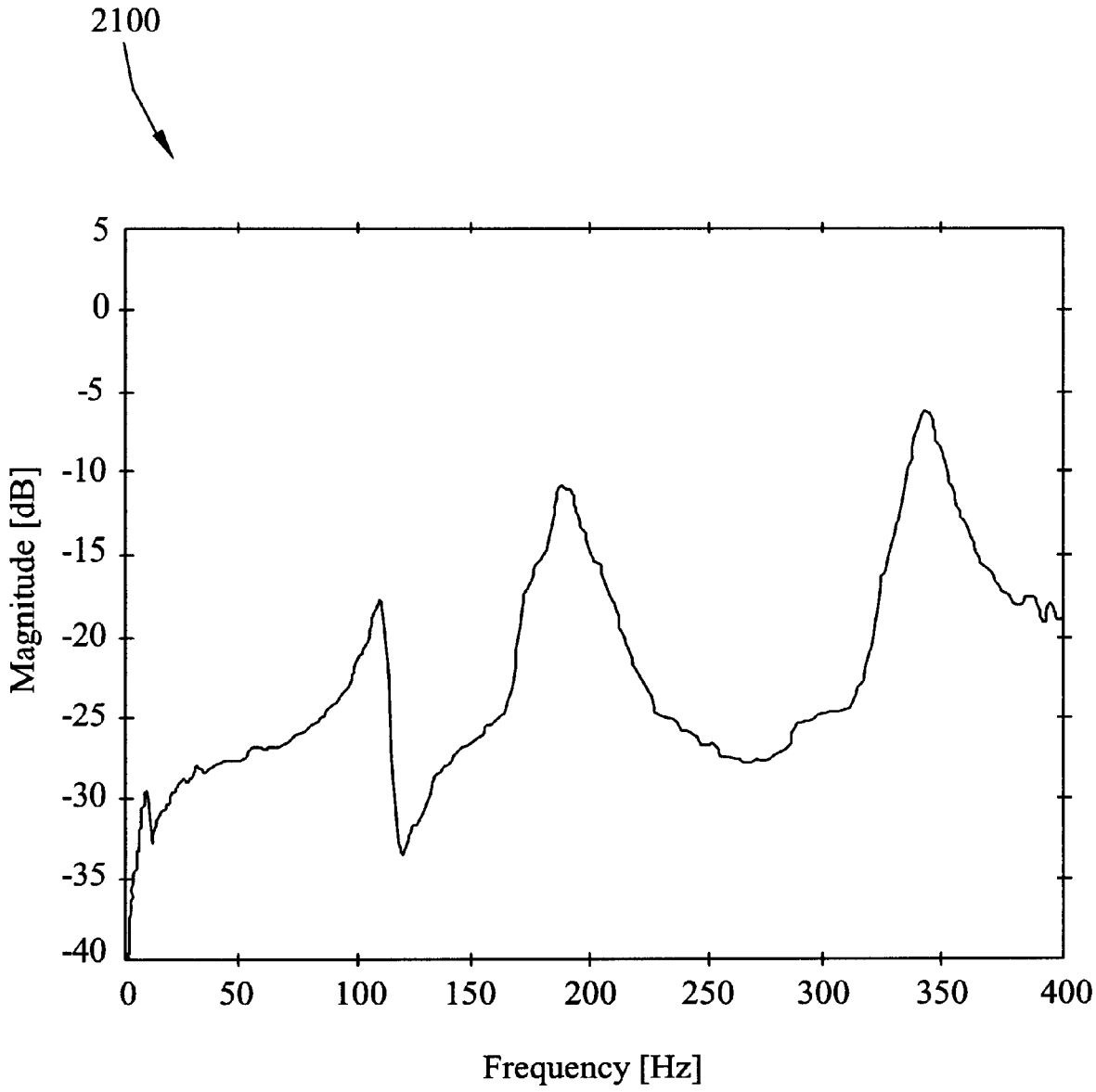
FIG. 21 is a graph of the open loop transfer function of the model in FIG. 20.

The analytical model served as a rough guide for choosing sensor and actuator locations 2010, 2020 (FIG. 20). It was necessary to further tailor the location, however, based on the true nature of the test specimen. The guitar top plate is not isotropic and of uniform thickness, although this approximation is a reasonable approximation to the first two out-of-plane mode shapes of the guitar. The guitar top plate is made up of a very thin, approximately 3 mm, wooden top plate with wooden stiffeners placed in an unsymmetric pattern beneath the top plate. This anisotropic behavior made it necessary to carry out a final modal survey to find good sensor and actuator locations 2010, 2020 (FIG. 20). With the guitar in its sandbox using the same hammer described in the initial modal survey as an actuator at position 18 in FIG. 2 to excite both the first and second plate modes 310, 320 (FIG. 3), several transfer functions were taken at different sensor positions on the top plate as described for experimental sensor and actuator location. PVDF was used, as a sensor in these transfer functions, because it senses in-plane motion in a similar fashion to the piezoceramics, but it is easily attached and removed using double sided tape. The differences in the geometry and structural properties of PVDF as compared to the piezoceramic sensors and actuators were ignored since neither material was expected to have a significant effect on the substructure mode shapes. As a result of this study, the locations 2010, 2020 shown in FIG. 20 were selected since they each had the highest magnitudes in both the first and second mode 310, 320 (FIG. 3). A 0.127 mm thick piezoceramic sensor 2030, measuring 1.1 cm by 2.1 cm in its horizontal and vertical directions, and a 0.127 mm thick actuator 2040, measuring 3.3 cm by 3.5 cm in its horizontal and vertical directions, were then bonded to the guitar top plate at the selected locations. Horizontal and vertical directions are also with reference to FIG. 20. Passive masses were attached to the guitar top plate to represent the shaker 750 (FIG. 7) and the accelerometer 760 (FIG. 7) masses which were present in the initial modal survey. The final open loop transfer function 2100 between the sensor 2030 (FIG. 20) and actuator 2040 (FIG. 20) location 2010, 2020 (FIG. 20) is shown in FIG. 21 using a white noise input into the actuator 2040 (FIG. 20) and the piezoceramic as a sensor 2030 (FIG. 20). This should only qualitatively be compared to the predicted behavior in FIG. 11 since the actual experimental sensors and actuator were of a different size and thickness than the those modeled, and they were bonded in different locations.

Figure 22:
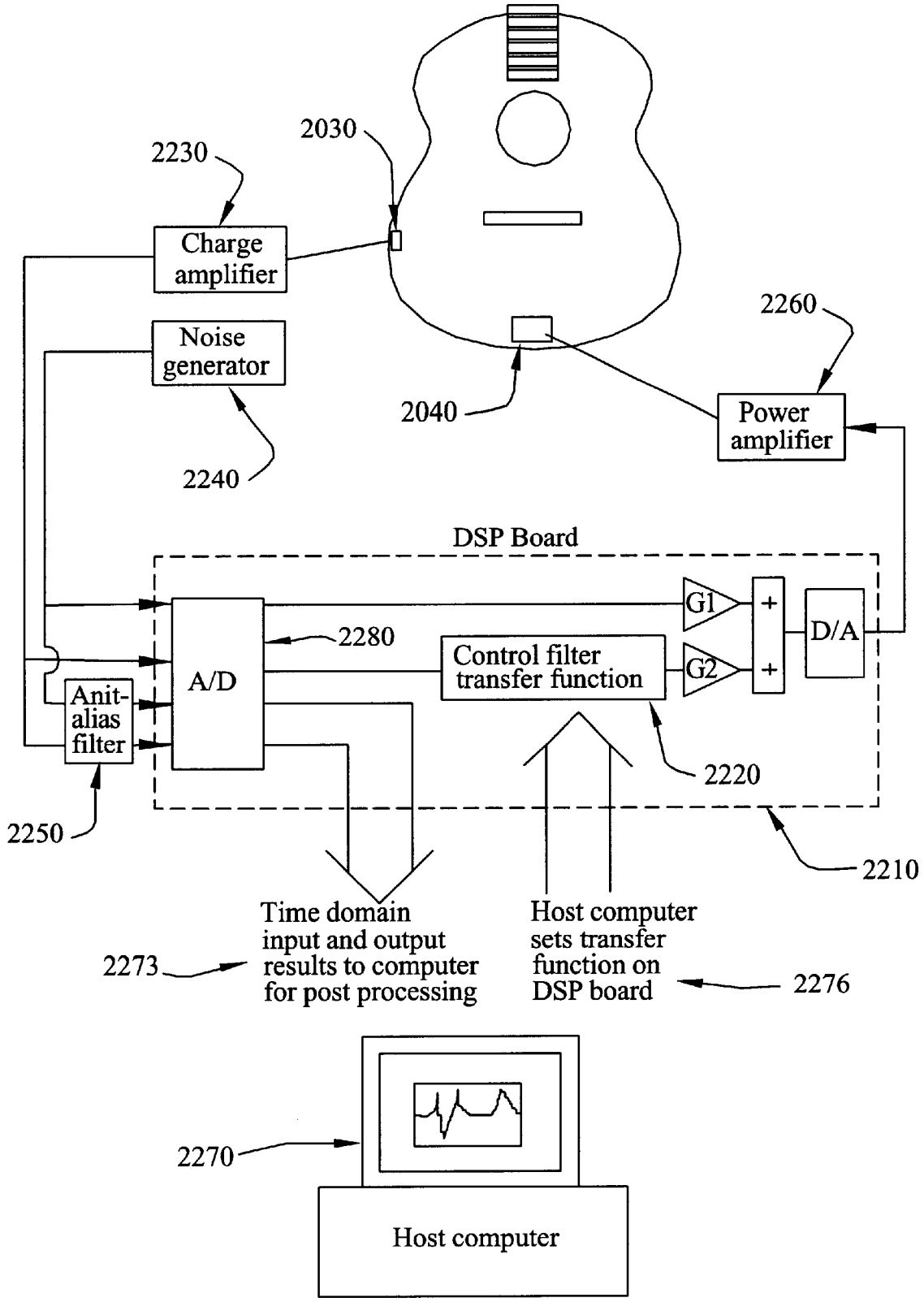
FIG. 22 is a schematic diagram for a control using a digital signal processing board.

It was not possible to apply the control filters designed using the model directly to the guitar test specimen due to differences in sensor and actuator size and properties, but it was possible to investigate their experimental implementation by allowing for an adjustable gain to compensate for these differences. The actual implementation of the effective control filters resulting from the pole placement method for control objectives 1 and 3 were implemented using a DS1102 DSP board 2210 (FIG. 22) from Dspace. This DSP board 2210 (FIG. 22) allows the user to load and execute a filter in the form of a transfer function 2220 (FIG. 20) programmed in Matlab software directly on hardware. The DSP board 2210 (FIG. 20) was also used to acquire data from the noise input and the sensor output for calculation of the open and closed loop structural transfer functions. The experimental setup for these measurements is shown in FIG. 22. As shown in FIG. 22, the experimental setup comprises a charge amplifier 2230 connected between the sensor 2030 an anti-alias filter 2250. The anti-alias 2250 is, in turn, connected to an A/D converter 2080 on the DSP board 2210. Additionally, a noise generator 2240 is connected to the anti-alias filter 2250. As shown in FIG. 22, the A/D converter produces a time domain input 2273, which is processed by a computer 2270. The computer 2270 sets, in 2276, the transfer function 2220 on the DSP board 2210. The DSP board 2210 is further connected to a power amplifier 2260, which is, in turn, attached to the actuator 2040 on the guitar.

Figure 23:
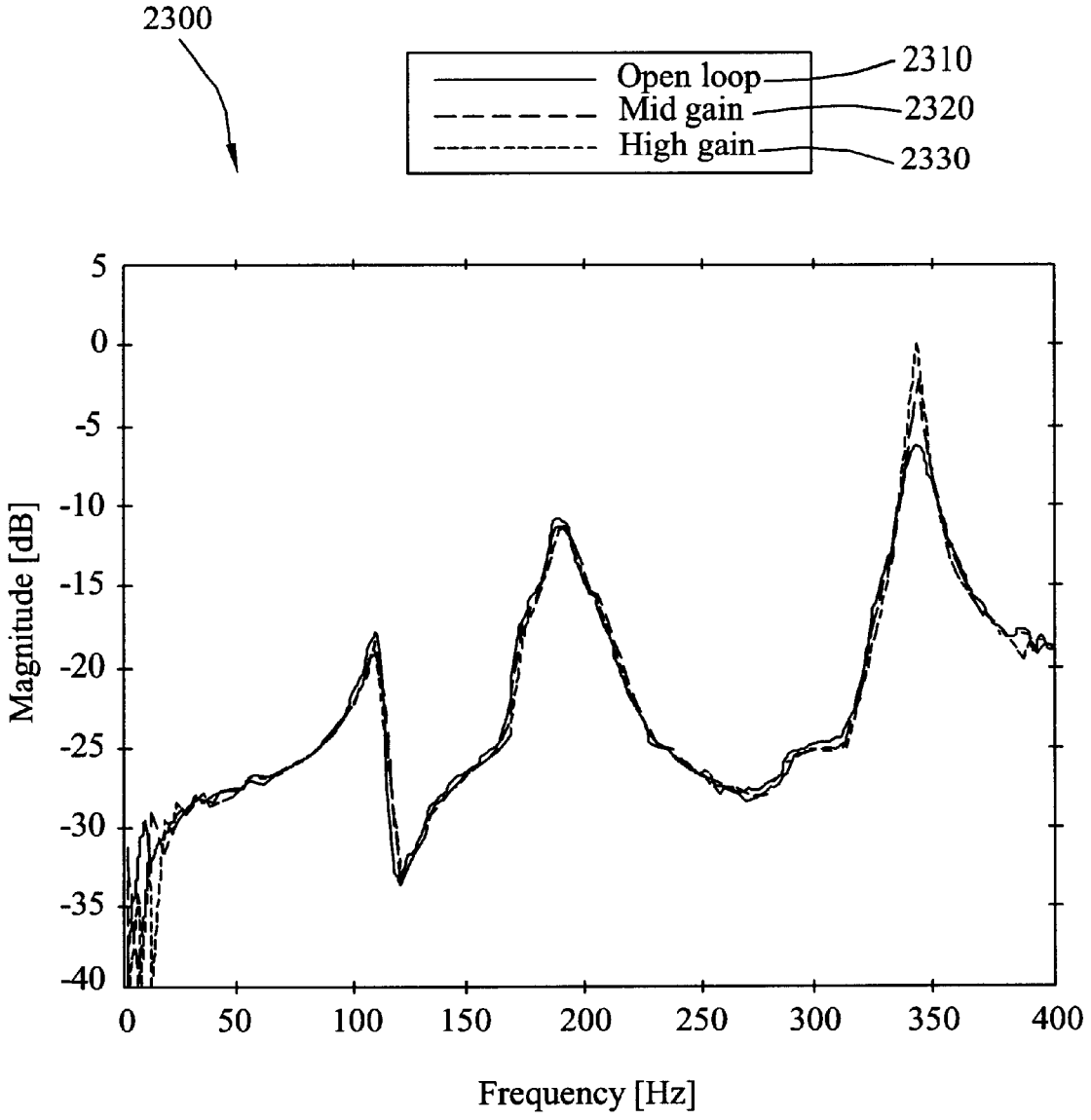
FIG. 23 is a graph of the direct implementation of objective 1 with varying gain.
Figure 24:
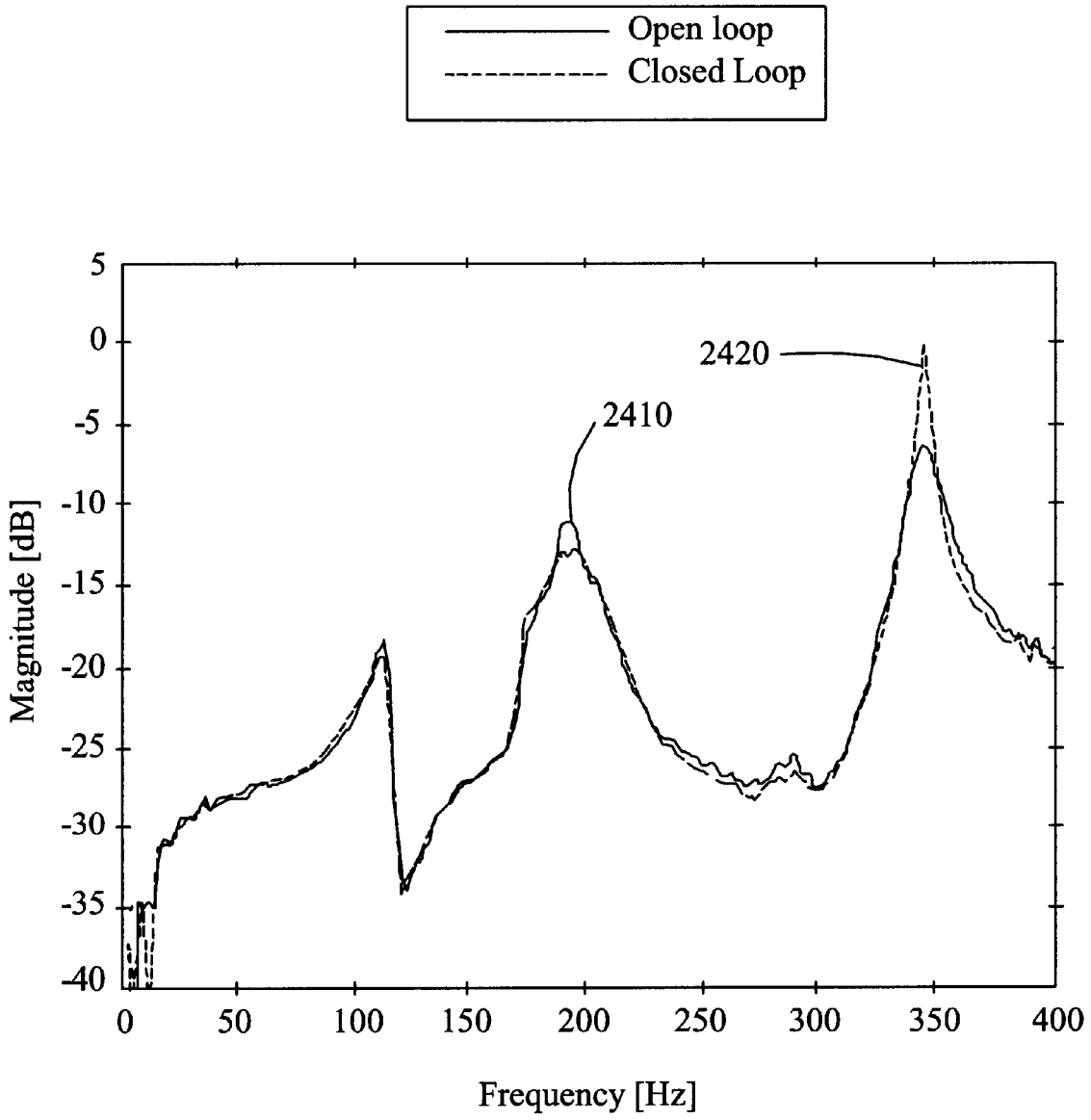
FIG. 24 is a graph of the direct implementation of objective 3.

The open and closed loop structural transfer functions 2030 using the effective control filter for control objective 1 is shown in FIG. 23 for two different gain values 2320, 2330. For this relatively simple control objective, the control filter did perform acceptably. Open and closed loop structural transfer functions 2410, 2420 using the effective control filter for control objective 3 are shown in FIG. 24 with the closed loop gain set 2420 to the same level as the higher gain 2330 in FIG. 23. In this case, the damping of the second, antisymmetric mode is obviously reduced more than the damping of the air mode and the first plate mode 310 (FIG. 3) are increased. This is due to the aforementioned discrepancies between the model and the actual experimental specimen. The relative amplitude ratios between the structural modes of the specimen and the structural modes in the model are different, so the controller formulated to influence more than one mode does not perform acceptably.

In addition to differences between the model and the test specimen already mentioned, a practical implementation of active control on the guitar would not be carried out with it submerged to the top plate in sand but with it being held by a guitar player. Recognizing that it is necessary to capture the actual behavior of the guitar under a more realistic boundary condition for further control design and simulation, it is useful to introduce the concept of transfer function modeling. A transfer function can be derived directly from sampled time records of a random noise disturbance and sensor outputs using the autoregressive moving average (ARMA) model. This method is based on assuming an input-output relationship of the model as $$y(k+1)=a_0y(k)+a_1y(k-1)+a_2y(k-2)+\ldots+a_ny(k-n)+b_0u(k+1)+b_1u(k)+\ldots+b_pu(k+1-p)+v(k). \quad (4.2)$$

where y(i) are the outputs, u(i) are the inputs, and v(k) is a random noise term. The model parameters to be found, based on the sampled data, are $$\theta=[a_0a_1\ldots a_nb_0b_1\ldots b_p],$$

which transforms Equation 4.2 into $$y(k+1)=[y(k)y(k-1)\ldots u(k+1)u(k)\ldots]\theta+v(k)=C(k)\theta+v(k). \quad (4.3)$$

Equations 4.3, can be combined at each time step to make one equation as $$\begin{bmatrix} y(k+1) \\ y(k+2) \\ \vdots \\ y(k+N) \end{bmatrix} = \begin{bmatrix} C(k) \\ C(k+1) \\ \vdots \\ C(k+N-1) \end{bmatrix}\theta + \begin{bmatrix} v(k) \\ v(k+1) \\ \vdots \\ v(k+N-1) \end{bmatrix}. \quad (4.4)$$

Equation 4.4 can then be solved approximately using a least squares estimation procedure. The parameters, θ, are directly related to the discrete transfer function by the input-output relation in Equation 4.2 as $$H(z) = \frac{b_0 + b_1 z^{-1} + \cdots + b_p z^{-p}}{1 - (a_0 z^{-1} + \cdots + a_{n-1} z^{-n})}.$$

Figure 25:
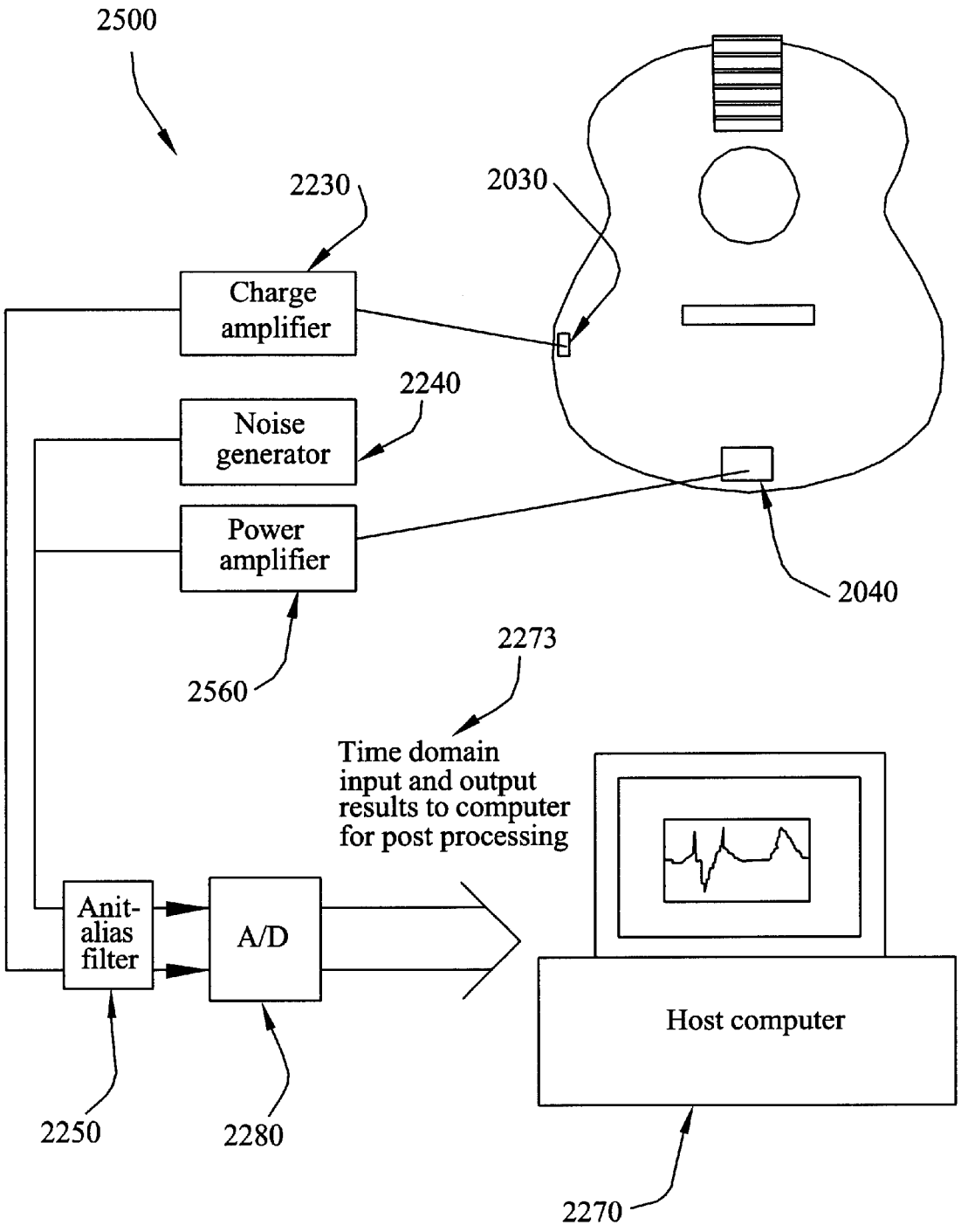
FIG. 25 is a diagram of the experimental schematic for system identification.

The discrete transfer function can then be mapped into a continuous-time transfer function or left as a discrete-time model for digital control design. An approximate transfer function was obtained using the ARMA model with a random noise input into the actuator while holding the guitar in a playing position. The associated experimental schematic 2500 is shown in FIG. 25. As shown in FIG. 25, the charge amplifier 2230 is positioned between the sensor 2030 and the anti-alias filter 2250, and a noise generator 2240 is connected to the anti-alias filter 2250, as in FIG. 22. Additionally, a power amplifier 2560 is positioned between the actuator 2040 and the anti-alias filter 2250. The anti-alias filter 2250 is connected to an A/D converter 2280, which, in turn, is attached to the computer 2270, which accepts the time domain input and output results. 2273 from the A/D converter 2280. Assuming n=50 and p=40, the identified ARMA transfer function, mapped into a continuous time-time transfer function, is given by $$\frac{\begin{aligned}
&-50.36s^{49} - 4.654\times10^{05}s^{48} - 9.33\times10^{09}s^{47} - 7.017\times10^{13}s^{46}\\
&-7.649\times10^{17}s^{45} - 4.813\times10^{21}s^{44} - 3.711\times10^{25}s^{43} - 1.988\times10^{29}s^{42}\\
&-1.196\times10^{33}s^{41} - 5.516\times10^{36}s^{40} - 2.713\times10^{40}s^{39} - 1.084\times10^{44}s^{38}\\
&-4.464\times10^{47}s^{37} - 1.543\times10^{51}s^{36} - 5.37\times10^{54}s^{35} - 1.591\times10^{58}s^{34}\\
&-4.643\times10^{61}s^{33} - 1.144\times10^{65}s^{32} - 2.678\times10^{68}s^{31} - 4.904\times10^{71}s^{30}\\
&-7.112\times10^{74}s^{29} - 5.705\times10^{76}s^{28} + 3.569\times10^{81}s^{27} + 1.708\times10^{85}s^{26}\\
&+5.417\times10^{88}s^{25} + 1.46\times10^{92}s^{24} + 3.429\times10^{95}s^{23} + 7.312\times10^{98}s^{22}\\
&+1.418\times10^{102}s^{21} + 2.531\times10^{105}s^{20} + 4.158\times10^{108}s^{19} + 6.303\times10^{111}s^{18}\\
&+8.81\times10^{114}s^{17} + 1.134\times10^{118}s^{16} + 1.343\times10^{121}s^{15} + 1.457\times10^{124}s^{14}\\
&+1.443\times10^{127}s^{13} + 1.3\times10^{130}s^{12} + 1.057\times10^{133}s^{11} + 7.712\times10^{135}s^{10}\\
&+4.999\times10^{138}s^{9} + 2.844\times10^{141}s^{8} + 1.403\times10^{144}s^{7} + 5.82\times10^{146}s^{6}\\
&+2.024\times10^{149}s^{5} + 5.322\times10^{151}s^{4} + 1.134\times10^{154}s^{3} + 1.465\times10^{156}s^{2}\\
&+2.34\times10^{157}s + 4.759\times10^{158}
\end{aligned}}{\begin{aligned}
&s^{50} + 6956s^{49} + 1.825\times10^{08}s^{48} + 1.128\times10^{12}s^{47} + 1.531\times10^{16}s^{46}\\
&+8.452\times10^{19}s^{45} + 7.851\times10^{23}s^{44} + 3.891\times10^{27}s^{43} + 2.761\times10^{31}s^{42}\\
&+1.233\times10^{35}s^{41} + 7.08\times10^{38}s^{40} + 2.853\times10^{42}s^{39} + 1.373\times10^{46}s^{38}\\
&+5.001\times10^{49}s^{37} + 2.06\times10^{53}s^{36} + 6.79\times10^{56}s^{35} + 2.429\times10^{60}s^{34}\\
&+7.246\times10^{63}s^{33} + 2.273\times10^{67}s^{32} + 6.131\times10^{70}s^{31} + 1.697\times10^{74}s^{30}\\
&+4.133\times10^{77}s^{29} + 1.013\times10^{81}s^{28} + 2.222\times10^{84}s^{27} + 4.825\times10^{87}s^{26}\\
&+9.509\times10^{90}s^{25} + 1.829\times10^{94}s^{24} + 3.224\times10^{97}s^{23} + 5.479\times10^{100}s^{22}\\
&+8.593\times10^{103}s^{21} + 1.284\times10^{107}s^{20} + 1.78\times10^{110}s^{19} + 2.325\times10^{113}s^{18}\\
&+2.821\times10^{116}s^{17} + 3.191\times10^{119}s^{16} + 3.351\times10^{122}s^{15} + 3.24\times10^{125}s^{14}\\
&+2.901\times10^{128}s^{13} + 2.356\times10^{131}s^{12} + 1.76\times10^{134}s^{11} + 1.171\times10^{137}s^{10}\\
&+7.087\times10^{139}s^{9} + 3.716\times10^{142}s^{8} + 1.747\times10^{145}s^{7} + 6.769\times10^{147}s^{6}\\
&+2.308\times10^{150}s^{5} + 5.831\times10^{152}s^{4} + 1.246\times10^{155}s^{3} + 1.64\times10^{157}s^{2}\\
&+5.125\times10^{158}s + 2.541\times10^{159}.
\end{aligned}}$$

Figure 26:
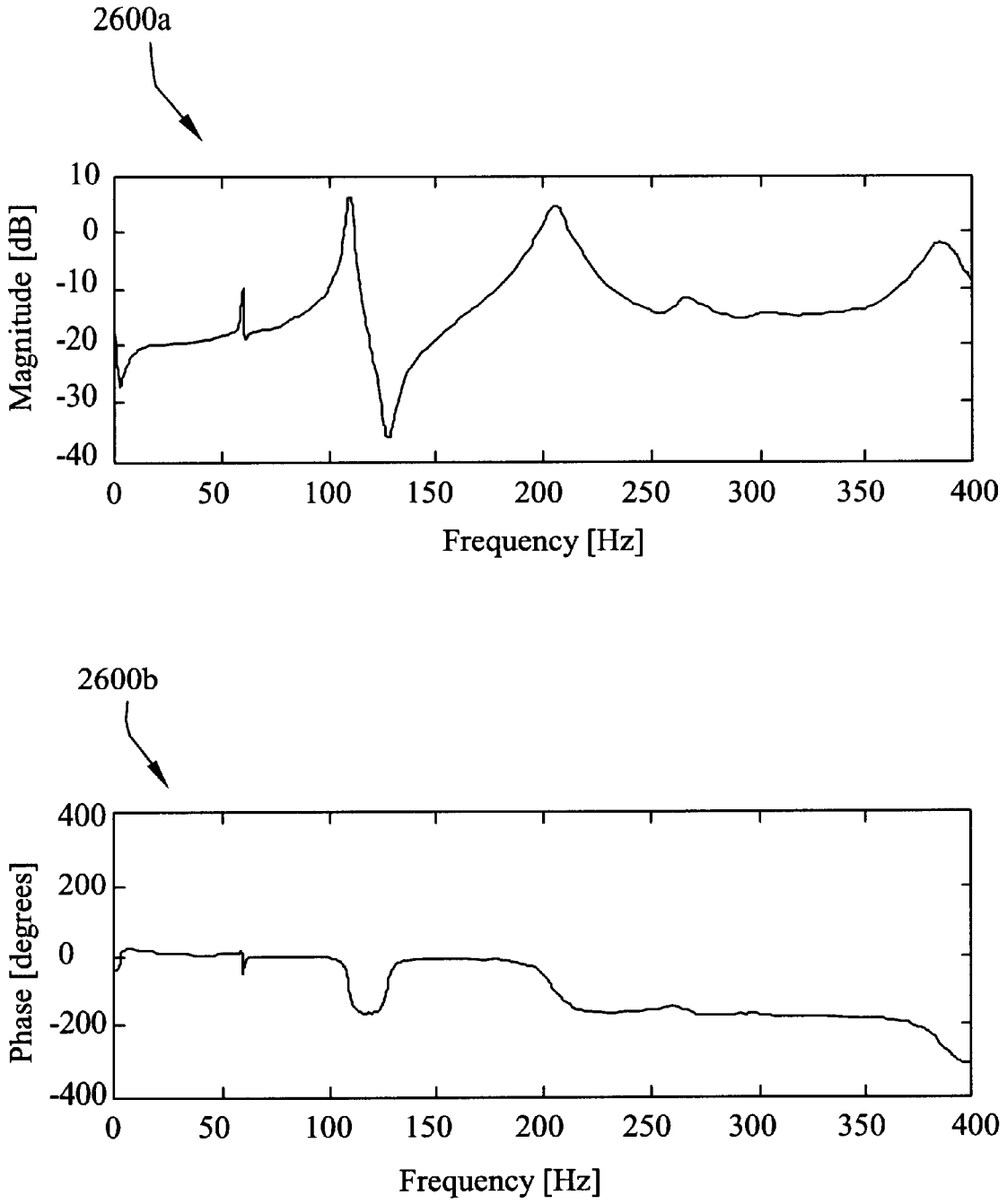
FIG. 26 illustrates graphs for the ARMA model representation of transfer function.
Figure 27:
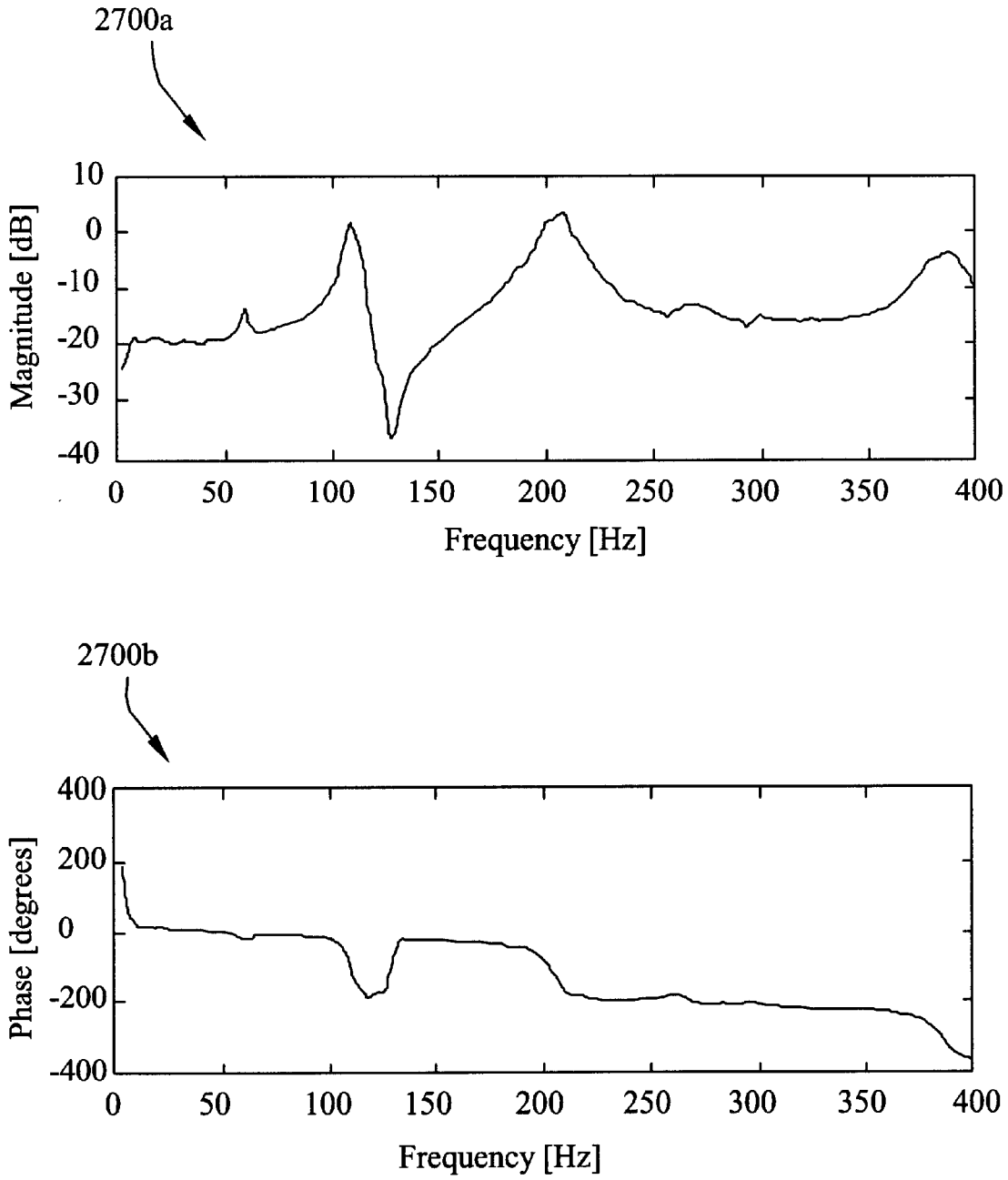
FIG. 27 illustrates graphs of a traditional FFT based measurement of transfer function.

This transfer function 2600*a*, 2600*b* is shown in FIG. 26. A transfer function 2700*a*, 2700*b* obtained from a traditional fast Fourier transform (FFT) method on the same time data is shown in FIG. 27 for comparison. A similar pattern of air mode, first plate mode 310 (FIG. 3), and second plate mode 320 (FIG. 3) is evident in the FIGS. 26 and 27, but the frequencies have shifted to 109 Hz for the air mode, 207 Hz for the first plate mode 310 (FIG. 3), and 386 Hz for the second plate mode 320 (FIG. 3). Also, the relative amplitudes of each mode have changed. A low pass filter was designed to decrease damping in the second mode 320 (FIG. 3). The transfer function of the filter is given by $$\frac{GAIN \times 2.047\times10^{5}}{s^2 + 153.4s + 5.849\times10^{6}}.$$

Figure 28:
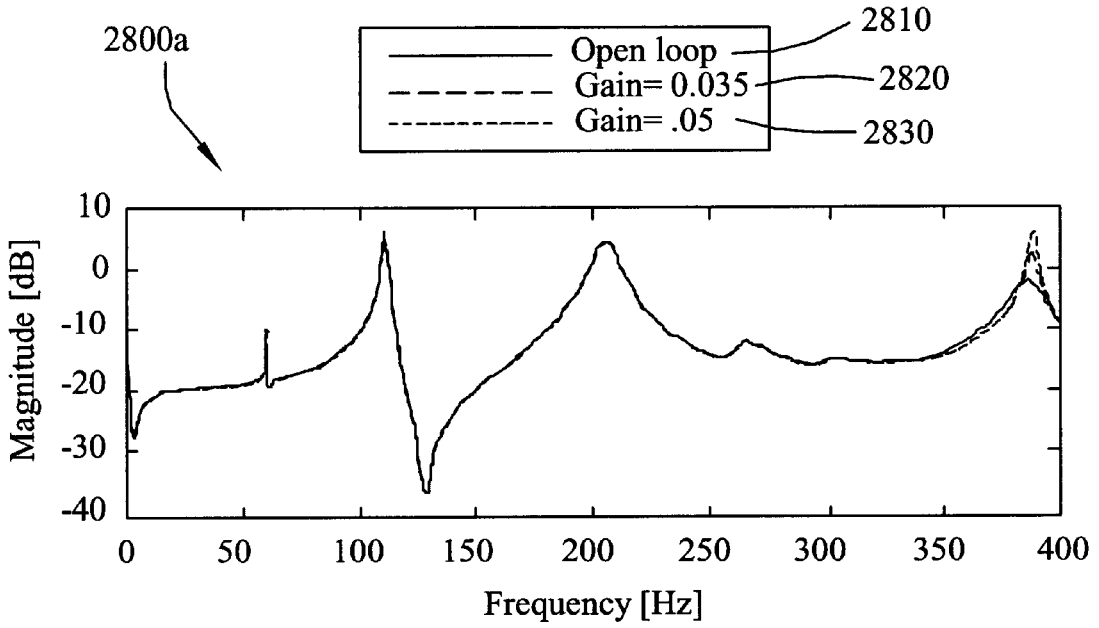
FIG. 28 illustrates graphs of the simulated implementation of objective 1 with varying gain.
Figure 28:
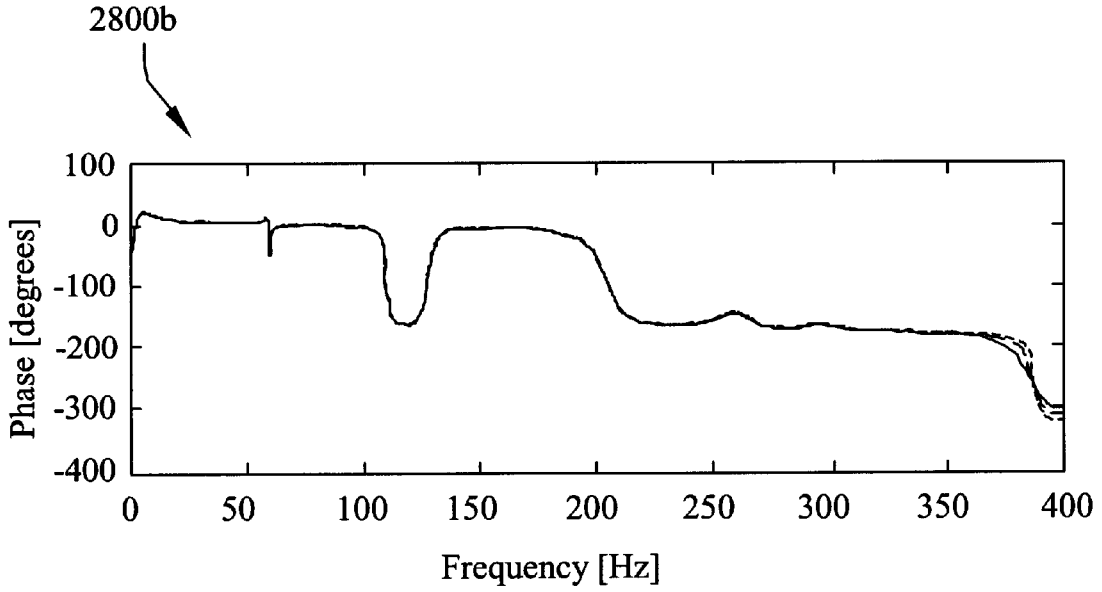

The simulated closed loop result 2800*a*, 2800*b* at values for GAIN of 0.035 2820 and 0.05 2830 are shown in FIG. 28.

Figure 29:
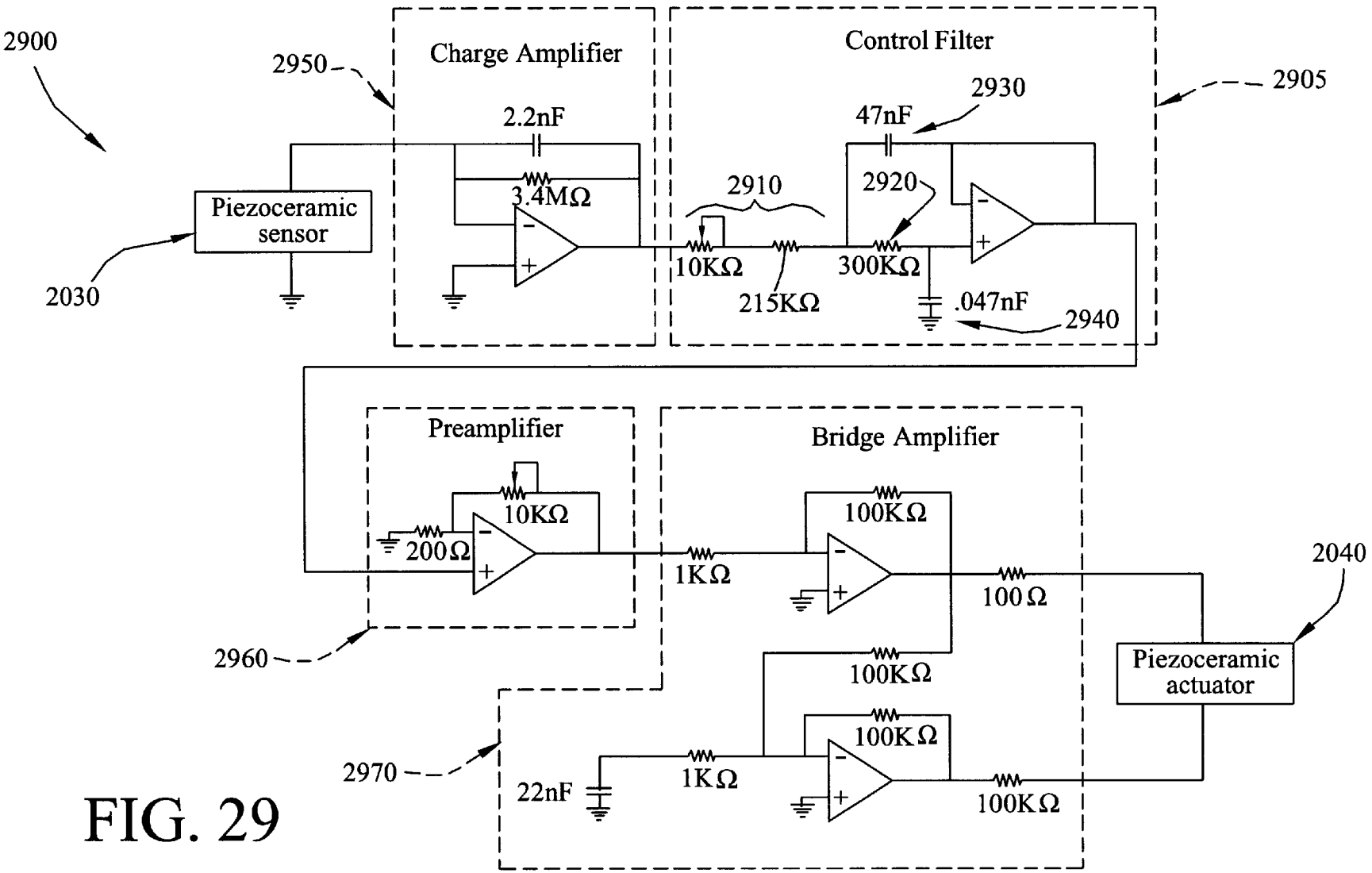
FIG. 29 is a schematic diagram of a portable control box.

The next step was to design a portable, battery-powered, analog control filter based on the DSP results to facilitate acoustic tests and to provide a more realistic embodiment of an active acoustic guitar. Such a portable control filter was constructed. Its finished dimensions were 13 cm×5 cm×7 cm including four 9 volt batteries, and its schematic 2900 is shown in FIG. 29. The resistor and capacitor values in the low pass filter came directly from the DSP board design. They are related to the filter damping and cutoff frequency by $$\omega_c = \sqrt{\frac{1}{R1\cdot R2\cdot C1\cdot C2}}, \quad \zeta = \sqrt{\frac{C2\cdot[R1+R2]^2}{R1\cdot R2\cdot C1\cdot 4}}.$$

Figure 30:
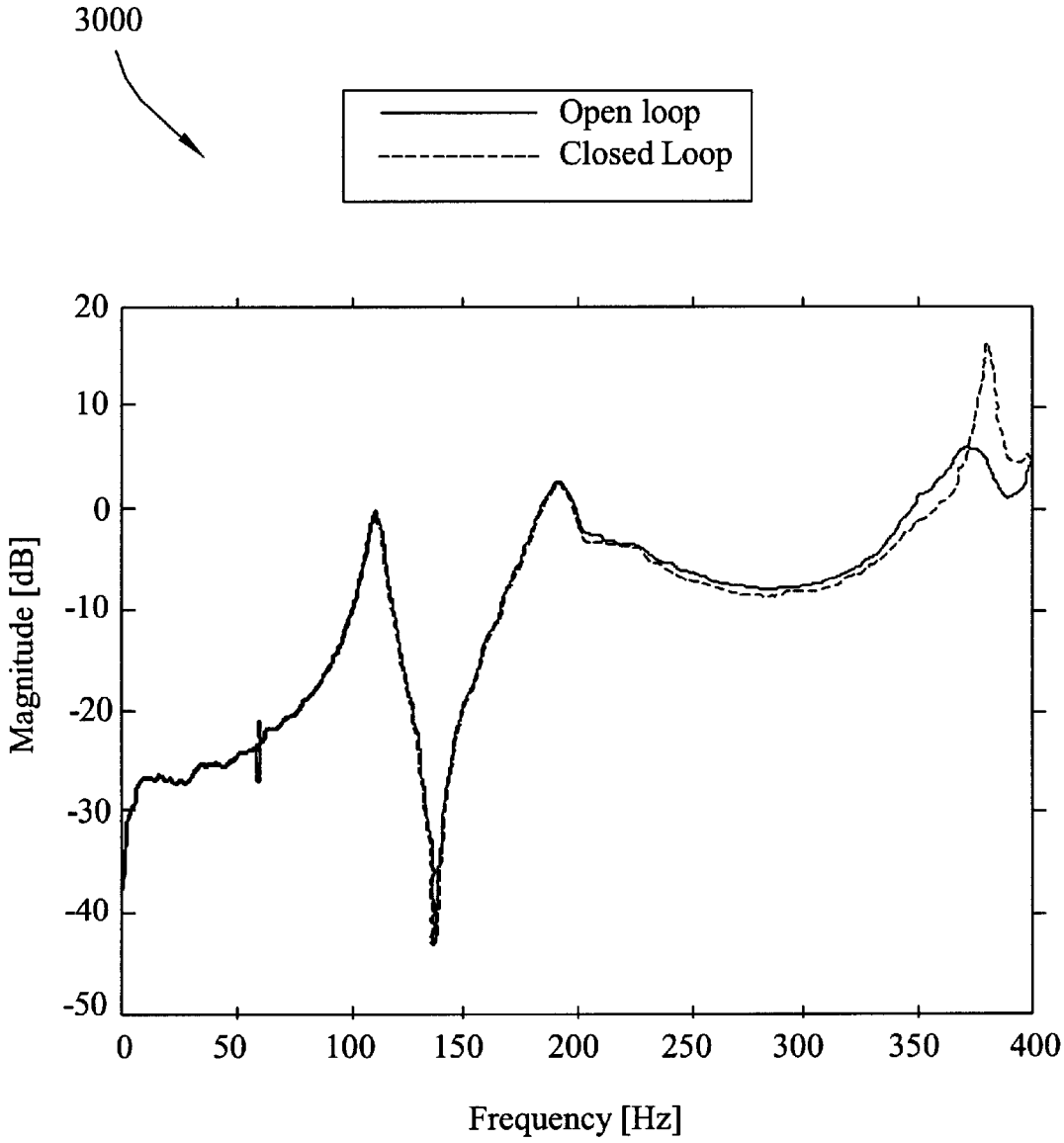
FIG. 30 is a graph of the measured open and closed loop structural transfer function.
Figure 31:
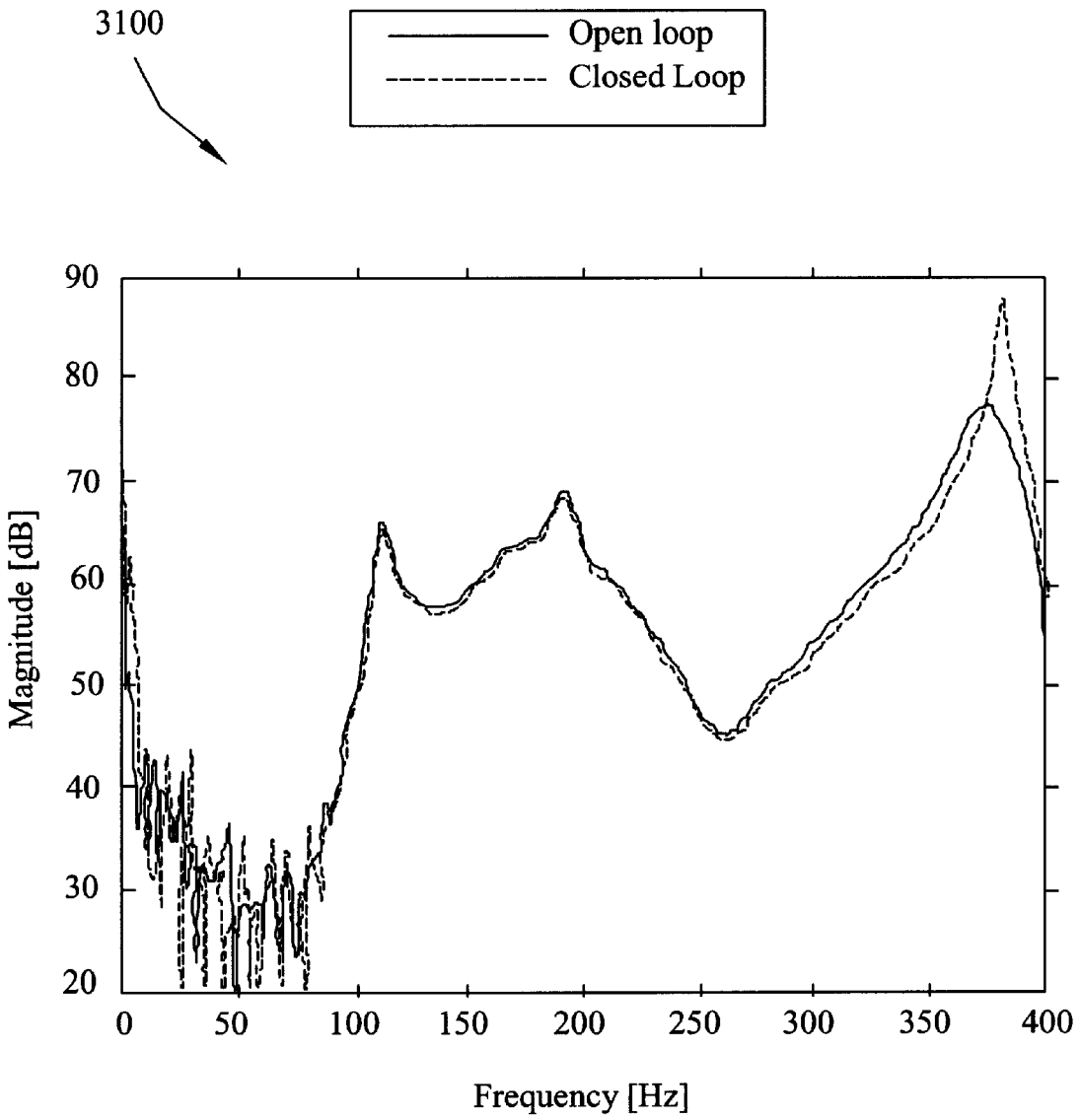
FIG. 31 is a graph of the measured open and closed loop SPL.

The locations of R12910, R22920, C12930, and C22940 in the low pass filter are also shown in FIG. 29. As shown in FIG. 29, in addition to the control filter 2905, the circut 2900 comprises a charge amplifier 2950 situated between the control filter 2905 and the sensor 2030. The control filter 2905 is further attached to a pre-amplifier 2960, which, in turn, is connected to a bridge amplifer 2970 that is attached to the actuator 2040. The open and closed loop structural and acoustic control results, using the portable filter, were then measured in anechoic tests similar to those earlier described, but with the piezoceramic actuator used as both the disturbance and the control actuator. The open and closed loop structural transfer function results 3000 are shown in FIG. 30. The open and closed loop acoustic transfer function results 3100, with the microphone located 0.3 m above position 1 in FIG. 2, are shown in FIG. 31. It is evident that closing the loop results in decreased damping in both the second antisymmetric structural mode and the corresponding structural/acoustic mode.

Structural/acoustic control in a "smart" acoustic guitar was shown to be a means of favorably adjusting factors that ultimately determine quality. This was done by specializing the model and control approaches to the acoustic guitar. The continuous model was shown to be affective in predicting the passive structural and acoustic behavior of the acoustic guitar. The discrete model and the control approach allowed simulation and implementation of control objectives on a "smart" guitar that were highly correlated with guitar quality. Predictions of both open- and closed-loop structural and acoustic behavior were verified experimentally.

While an embodiment of a system for acoustic mimicry using a smart acoustic instrument and modifications thereof have been shown and described in detail herein, various additional changes and modifications may be made without departing from the scope of the present invention.

What is claimed is:

1. An acoustic musical instrument which is able to produce sound waves comprising:

a structural component capable of vibration;

an electronic sensor for reading the vibration of said instrument and converting said vibration to an electronic signal;

an electronic actuator coupled to said structural component for altering the vibration of said structural component; and a control filter for converting said electronic sensor signal to an electronic actuator signal for improving sound quality.

2. A sound control system for an acoustic musical instrument having a structure that forms an acoustic chamber and acoustic generating means for inducing a natural acoustic within the acoustic chamber comprising:

at least one sensor disposed adjacent a sensing location of the structure, the sensor configured to generate sensed electric signals indicative of the magnitude of structural vibration of the structure at the sensing location;

a controller in communication with the sensor, the controller including a processor for processing the sensed electric signals in accordance with a predetermined method and for producing output electrical signals, wherein the processor includes one or more devices selected from the group consisting of: a microprocessor, microcontroller, or application specific integrated circuit;

at least one actuator integrally disposed at an actuator location of the structure, the actuator in communication with the controller and configured to receive the output electrical signals and alter the structural vibration of the structure at the actuator location;

whereby the vibration of the structure at the actuator location creates acoustics within the acoustic chamber that combine with the natural acoustic to alter the sound emanating from the acoustic chamber.

3. The system as defined in claim 2, wherein the predetermined method includes a computer program designed to execute on the one or more devices.

* * * * *

UNITED STATES PATENT AND TRADEMARK OFFICE

CERTIFICATE OF CORRECTION

PATENT NO. : 6,320,113 B1
DATED : November 20, 2001
INVENTOR(S) : Griffin et al.

It is certified that error appears in the above-identified patent and that said Letters Patent is hereby corrected as shown below:

Title page,
Item [*] Notice, delete "1062" and insert -- 699 --.

Signed and Sealed this

Eighth Day of July, 2003

JAMES E. ROGAN
*Director of the United States Patent and Trademark Office*